US007971699B2

(12) United States Patent
Molbak et al.

(10) Patent No.: US 7,971,699 B2
(45) **Date of Patent: *Jul. 5, 2011**

(54) COIN COUNTER/SORTER AND COUPON/VOUCHER DISPENSING MACHINE AND METHOD

(75) Inventors: Jens H. Molbak, Portola Valley, CA (US); Vae E. Sun, Palo Alto, CA (US)

(73) Assignee: Coinstar, Inc., Bellevue, WA (US)

( * ) Notice: Subject to any disclaimer, the term of this patent is extended or adjusted under 35 U.S.C. 154(b) by 903 days.

This patent is subject to a terminal disclaimer.

(21) Appl. No.: 11/336,413

(22) Filed: Jan. 20, 2006

(65) Prior Publication Data

US 2006/0219519 A1 Oct. 5, 2006

Related U.S. Application Data

(63) Continuation of application No. 08/689,826, filed on Aug. 12, 1996, now Pat. No. 7,028,827, which is a continuation of application No. 08/255,539, filed on Jun. 6, 1994, now Pat. No. 5,564,546, which is a continuation of application No. 07/940,931, filed on Sep. 4, 1992, now abandoned.

(51) Int. Cl.
*G06M 3/06* (2006.01)

(52) U.S. Cl. ..... 194/215

(58) Field of Classification Search ..... 194/215
See application file for complete search history.

(56) References Cited

U.S. PATENT DOCUMENTS

| | | | |
|---|---|---|---|
| 269,461 | A | 12/1882 | Rakestraw |
| 446,303 | A | 2/1891 | Thompson |
| 545,185 | A | 8/1895 | Yost |
| 1,010,993 | A | 12/1911 | White |
| 1,234,707 | A | 7/1917 | Whistler |
| 1,345,858 | A | 7/1920 | Jenkins |
| 1,711,049 | A | 4/1929 | Fonda et al. |

(Continued)

FOREIGN PATENT DOCUMENTS

| | | |
|---|---|---|
| CA | 1053598 | 2/1979 |

(Continued)

OTHER PUBLICATIONS

Civil Docket for Case #: 1:07-cv-05285; *Coinstar, Inc.* v. *Scan Coin North America, Inc.*; U.S. District Court for the Northern District of Illinois, Eastern Division; 5 pages.

(Continued)

*Primary Examiner* — Stefanos Karmis
*Assistant Examiner* — Mark J Beauchaine
(74) *Attorney, Agent, or Firm* — Perkins Coie LLP

(57) ABSTRACT

A coin sorting and counting machine and a method for operating it to automatically dispense cash vouchers based on the value of the counted coins, manufacturers' coupons and store coupons. Coins are placed in a hopper tray. When the hinged tray is lifted, the coins travel through a waste management system and into the coin sorting and counting apparatus. The value of the coins and the number of coins within each denomination are displayed as the coins are counted. After sorting, the coins fall into a temporary holding area. At this point the transaction can either be canceled or accepted. If the transaction is canceled, the coins are returned. If the transaction is accepted, the coins fall into a storage area and the user is issued a cash voucher and a series of store coupons. Manufacturers' coupons are dispensed regardless of whether or not the transaction is accepted.

39 Claims, 10 Drawing Sheets

U.S. PATENT DOCUMENTS

| | | | | |
|---|---|---|---|---|
| 1,813,296 | A | | 7/1931 | Kidwell |
| 1,847,940 | A | | 3/1932 | Giles |
| 1,945,948 | A | | 2/1934 | Morin |
| 2,014,505 | A | | 9/1935 | Patche |
| 2,317,351 | A | | 4/1943 | Andalikiewicz et al. |
| 2,461,314 | A | | 2/1949 | Davis et al. |
| 2,569,360 | A | | 9/1951 | Weingart |
| 2,644,470 | A | | 7/1953 | Labbe |
| 2,865,561 | A | | 12/1958 | Rosapepe |
| 2,881,774 | A | | 4/1959 | Labbe |
| 2,960,377 | A | | 1/1960 | Simjian |
| 3,009,555 | A | | 11/1961 | Seckula, Sr. |
| 3,048,251 | A | | 8/1962 | Bower |
| 3,056,132 | A | | 9/1962 | Simjian |
| 3,065,467 | A | | 11/1962 | Prevost |
| 3,132,654 | A | | 5/1964 | Adams |
| 3,173,742 | A | | 3/1965 | Simjian |
| 3,196,257 | A | | 7/1965 | Buchholtz et al. |
| 3,227,363 | A | | 1/1966 | Hecker et al. |
| 3,286,805 | A | | 11/1966 | New |
| 3,396,737 | A | | 8/1968 | Picollo |
| 3,415,348 | A | | 12/1968 | Wahlberg |
| 3,599,771 | A | | 8/1971 | Hinterstocker |
| 3,603,327 | A | | 9/1971 | Buchholz et al. |
| 3,709,145 | A | | 1/1973 | Williamson |
| 3,763,871 | A | | 10/1973 | Jobst |
| 3,788,440 | A | | 1/1974 | Propice et al. |
| 3,791,574 | A | * | 2/1974 | Picquot ..... 232/44 |
| 3,815,717 | A | | 6/1974 | Arseneau |
| 3,941,226 | A | | 3/1976 | Drakes |
| 3,960,293 | A | | 6/1976 | Sweet, II et al. |
| 3,969,584 | A | | 7/1976 | Miller et al. |
| 3,982,620 | A | | 9/1976 | Kortenhaus |
| 3,984,660 | A | * | 10/1976 | Oka et al. ..... 235/381 |
| 3,998,237 | A | | 12/1976 | Kressin et al. |
| 4,014,424 | A | | 3/1977 | Hall |
| 4,036,242 | A | | 7/1977 | Breitenstein et al. |
| 4,058,954 | A | | 11/1977 | Asami et al. |
| 4,059,122 | A | | 11/1977 | Kinoshita et al. |
| 4,092,990 | A | | 6/1978 | Bayne |
| 4,099,722 | A | | 7/1978 | Rodesch et al. |
| 4,100,925 | A | | 7/1978 | Fukunaga et al. |
| 4,106,610 | A | | 8/1978 | Heiman |
| 4,124,109 | A | | 11/1978 | Bissell et al. |
| 4,141,372 | A | | 2/1979 | Gdanski |
| 4,167,949 | A | | 9/1979 | Hashimoto et al. |
| 4,172,462 | A | | 10/1979 | Uchida et al. |
| 4,225,056 | A | | 9/1980 | Flubacker |
| 4,228,811 | A | | 10/1980 | Tanaka et al. |
| 4,230,213 | A | | 10/1980 | Spring |
| 4,249,552 | A | | 2/1981 | Margolin et al. |
| 4,266,121 | A | | 5/1981 | Hirose et al. |
| 4,275,751 | A | | 6/1981 | Bergman |
| 4,306,644 | A | | 12/1981 | Rockola et al. |
| 4,321,672 | A | | 3/1982 | Braun et al. |
| 4,326,620 | A | | 4/1982 | Felix et al. |
| 4,346,798 | A | | 8/1982 | Agey, III |
| 4,356,829 | A | | 11/1982 | Furuya |
| 4,360,034 | A | | 11/1982 | Davila et al. |
| 4,369,442 | A | | 1/1983 | Werth et al. |
| 4,369,800 | A | | 1/1983 | Watanabe et al. |
| 4,374,557 | A | | 2/1983 | Sugimoto et al. |
| 4,376,442 | A | | 3/1983 | Gomez et al. |
| 4,380,316 | A | | 4/1983 | Glinka et al. |
| 4,383,540 | A | | 5/1983 | De Meyer et al. |
| 4,398,550 | A | | 8/1983 | Shireman |
| 4,412,292 | A | | 10/1983 | Sedam et al. |
| 4,412,607 | A | | 11/1983 | Collins et al. |
| 4,434,359 | A | | 2/1984 | Watanabe et al. |
| 4,436,103 | A | | 3/1984 | Dick |
| 4,442,850 | A | | 4/1984 | Austin et al. |
| 4,447,714 | A | | 5/1984 | Lundblad et al. |
| 4,503,963 | A | | 3/1985 | Steiner |
| 4,504,357 | A | | 3/1985 | Holbein et al. |
| 4,506,685 | A | | 3/1985 | Childers et al. |
| 4,509,122 | A | | 4/1985 | Agnew et al. |
| 4,509,633 | A | | 4/1985 | Chow |
| 4,542,817 | A | | 9/1985 | Paulson |
| 4,543,969 | A | | 10/1985 | Rasmussen |
| 4,554,446 | A | | 11/1985 | Murphy et al. |
| 4,558,711 | A | | 12/1985 | Ikuta Yoshiaki et al. |
| 4,577,744 | A | | 3/1986 | Doucet |
| 4,587,984 | A | | 5/1986 | Levasseur et al. |
| 4,597,487 | A | | 7/1986 | Crosby et al. |
| 4,598,378 | A | | 7/1986 | Giacomo |
| 4,611,205 | A | | 9/1986 | Eglise et al. |
| 4,616,323 | A | | 10/1986 | Hayashi |
| 4,616,776 | A | | 10/1986 | Blumenthal et al. |
| 4,620,559 | A | | 11/1986 | Childers et al. |
| 4,622,456 | A | | 11/1986 | Naruto et al. |
| 4,674,055 | A | | 6/1987 | Ogaki et al. |
| 4,677,565 | A | | 6/1987 | Ogaki et al. |
| 4,694,845 | A | | 9/1987 | Zay |
| 4,706,577 | A | | 11/1987 | Jones et al. |
| 4,706,795 | A | | 11/1987 | Mikami et al. |
| 4,716,799 | A | | 1/1988 | Hartmann |
| 4,723,212 | A | | 2/1988 | Mindrum et al. |
| 4,733,765 | A | | 3/1988 | Watanabe et al. |
| 4,753,625 | A | | 6/1988 | Okada et al. |
| 4,775,353 | A | | 10/1988 | Childers et al. |
| 4,775,354 | A | | 10/1988 | Rasmussen et al. |
| 4,809,837 | A | | 3/1989 | Hayashi et al. |
| 4,814,589 | A | | 3/1989 | Storch et al. |
| 4,831,374 | A | | 5/1989 | Masel |
| 4,833,308 | A | | 5/1989 | Humble |
| 4,883,158 | A | | 11/1989 | Kobayashi et al. |
| 4,884,672 | A | | 12/1989 | Parker |
| 4,896,791 | A | | 1/1990 | Smith |
| 4,898,564 | A | | 2/1990 | Gunn et al. |
| 4,910,672 | A | | 3/1990 | Off et al. |
| 4,915,205 | A | | 4/1990 | Reid et al. |
| 4,921,463 | A | | 5/1990 | Primdahl et al. |
| 4,936,436 | A | | 6/1990 | Keltner |
| 4,953,086 | A | | 8/1990 | Fukatsu et al. |
| 4,959,624 | A | | 9/1990 | Higgins, Jr. et al. |
| 4,963,118 | A | * | 10/1990 | Gunn et al. ..... 453/3 |
| 4,964,495 | A | | 10/1990 | Rasmussen |
| 4,969,549 | A | | 11/1990 | Eglise et al. |
| 4,977,502 | A | * | 12/1990 | Baker et al. ..... 705/13 |
| 4,978,322 | A | | 12/1990 | Paulsen |
| 4,995,848 | A | | 2/1991 | Goh et al. |
| 4,997,406 | A | | 3/1991 | Horiguchi et al. |
| 5,010,238 | A | | 4/1991 | Kadono et al. |
| 5,021,967 | A | | 6/1991 | Smith |
| 5,022,889 | A | | 6/1991 | Ristvedt et al. |
| 5,025,139 | A | | 6/1991 | Halliburton, Jr. |
| 5,027,937 | A | | 7/1991 | Parish et al. |
| 5,039,848 | A | | 8/1991 | Stoken |
| 5,040,657 | A | | 8/1991 | Gunn et al. |
| 5,055,657 | A | | 10/1991 | Miller et al. |
| 5,056,644 | A | | 10/1991 | Parker |
| 5,073,767 | A | | 12/1991 | Holmes et al. |
| 5,083,765 | A | | 1/1992 | Kringel |
| 5,083,814 | A | | 1/1992 | Guinta et al. |
| 5,088,587 | A | | 2/1992 | Goodrich et al. |
| 5,091,713 | A | | 2/1992 | Horne et al. |
| 5,098,339 | A | | 3/1992 | Dabrowski |
| 5,098,340 | A | | 3/1992 | Abe |
| 5,100,367 | A | | 3/1992 | Abe et al. |
| 5,111,927 | A | | 5/1992 | Schulze, Jr. |
| 5,114,381 | A | | 5/1992 | Ueda et al. |
| 5,135,433 | A | | 8/1992 | Watanabe et al. |
| 5,163,868 | A | | 11/1992 | Adams et al. |
| 5,173,851 | A | | 12/1992 | Off et al. |
| 5,174,608 | A | | 12/1992 | Benardelli et al. |
| 5,183,142 | A | | 2/1993 | Latchinian et al. |
| 5,195,626 | A | | 3/1993 | Le Hong et al. |
| 5,197,588 | A | | 3/1993 | Furuya et al. |
| 5,201,396 | A | | 4/1993 | Chalabian et al. |
| 5,219,059 | A | | 6/1993 | Furuya et al. |
| 5,226,519 | A | | 7/1993 | DeWoolfson |
| 5,227,966 | A | * | 7/1993 | Ichiba ..... 705/16 |
| 5,236,339 | A | | 8/1993 | Nishiumi et al. |
| 5,251,738 | A | | 10/1993 | Dabrowski |
| 5,252,811 | A | | 10/1993 | Henochowicz et al. |
| 5,293,981 | A | | 3/1994 | Abe et al. |
| 5,299,672 | A | | 4/1994 | Nishiumi et al. |

| | | | | |
|---|---|---|---|---|
| 5,299,673 | A | 4/1994 | Wu | |
| 5,302,811 | A | 4/1994 | Fukatsu | |
| 5,316,120 | A | 5/1994 | Ibarrola et al. | |
| 5,316,517 | A | 5/1994 | Chiba et al. | |
| 5,317,135 | A * | 5/1994 | Finocchio | 463/17 |
| 5,321,242 | A | 6/1994 | Heath, Jr. | |
| 5,328,014 | A | 7/1994 | Nishiumi et al. | |
| 5,330,041 | A | 7/1994 | Dobbins et al. | |
| 5,350,906 | A | 9/1994 | Brody et al. | |
| 5,355,988 | A * | 10/1994 | Shirasawa | 194/217 |
| 5,365,046 | A | 11/1994 | Haymann | |
| 5,374,814 | A | 12/1994 | Kako et al. | |
| 5,388,680 | A | 2/1995 | Hird et al. | |
| 5,409,092 | A | 4/1995 | Itako et al. | |
| 5,429,222 | A | 7/1995 | Delay et al. | |
| 5,435,777 | A | 7/1995 | Takatani et al. | |
| 5,441,139 | A | 8/1995 | Abe et al. | |
| 5,449,058 | A | 9/1995 | Kotler et al. | |
| 5,457,305 | A | 10/1995 | Akel et al. | |
| 5,469,951 | A | 11/1995 | Takemoto et al. | |
| 5,479,507 | A | 12/1995 | Anderson | |
| 5,483,363 | A | 1/1996 | Holmes et al. | |
| 5,506,393 | A | 4/1996 | Ziarno | |
| 5,513,738 | A | 5/1996 | Hird et al. | |
| 5,554,070 | A | 9/1996 | Takatoshi et al. | |
| 5,555,497 | A | 9/1996 | Helbling | |
| 5,560,467 | A | 10/1996 | Takemoto | |
| 5,564,546 | A | 10/1996 | Molbak et al. | |
| 5,577,959 | A | 11/1996 | Takemoto et al. | |
| 5,620,079 | A | 4/1997 | Molbak | |
| 5,637,845 | A | 6/1997 | Kolls | |
| 5,652,421 | A | 7/1997 | Veeneman et al. | |
| 5,665,952 | A | 9/1997 | Ziarno | |
| 5,679,070 | A | 10/1997 | Ishida et al. | |
| 5,696,908 | A | 12/1997 | Muehlberger et al. | |
| 5,699,328 | A | 12/1997 | Ishizaki et al. | |
| 5,732,398 | A | 3/1998 | Tagawa | |
| 5,743,429 | A | 4/1998 | Morofsky | |
| 5,746,299 | A | 5/1998 | Molbak et al. | |
| 5,746,322 | A | 5/1998 | LaVeine et al. | |
| 5,799,767 | A * | 9/1998 | Molbak | 194/217 |
| 5,839,956 | A | 11/1998 | Takemoto | |
| 5,842,916 | A | 12/1998 | Gerrity et al. | |
| 5,868,236 | A | 2/1999 | Rademacher | |
| 5,880,444 | A | 3/1999 | Shibata et al. | |
| 5,909,792 | A | 6/1999 | Gerlier et al. | |
| 5,909,793 | A | 6/1999 | Beach et al. | |
| 5,909,794 | A | 6/1999 | Molbak et al. | |
| 5,974,146 | A | 10/1999 | Randle et al. | |
| 5,991,413 | A | 11/1999 | Arditti et al. | |
| 6,017,063 | A * | 1/2000 | Nilssen | 283/67 |
| 6,021,883 | A | 2/2000 | Casanova et al. | |
| 6,047,807 | A | 4/2000 | Molbak et al. | |
| 6,053,807 | A | 4/2000 | Metzger et al. | |
| 6,068,550 | A | 5/2000 | Breitholtz et al. | |
| 6,105,009 | A | 8/2000 | Cuervo | |
| 6,110,044 | A | 8/2000 | Stern | |
| 6,116,402 | A | 9/2000 | Beach et al. | |
| 6,119,099 | A | 9/2000 | Walker et al. | |
| 6,138,106 | A | 10/2000 | Walker et al. | |
| 6,144,946 | A | 11/2000 | Iwamura | |
| 6,185,545 | B1 | 2/2001 | Resnick et al. | |
| 6,227,343 | B1 | 5/2001 | Neathway et al. | |
| 6,230,928 | B1 | 5/2001 | Hanna et al. | |
| 6,233,564 | B1 | 5/2001 | Schulze, Jr. | |
| 6,289,324 | B1 | 9/2001 | Kawan | |
| 6,292,211 | B1 | 9/2001 | Pena | |
| 6,318,536 | B1 * | 11/2001 | Korman et al. | 194/217 |
| 6,349,972 | B1 | 2/2002 | Geiger et al. | |
| 6,375,080 | B1 | 4/2002 | Cremonese | |
| 6,401,010 | B1 | 6/2002 | Takahashi | |
| 6,405,182 | B1 | 6/2002 | Cuervo | |
| 6,415,262 | B1 | 7/2002 | Walker et al. | |
| 6,484,863 | B1 | 11/2002 | Molbak | |
| 6,494,776 | B1 | 12/2002 | Molbak | |
| 6,505,774 | B1 | 1/2003 | Fulcher et al. | |
| 6,536,037 | B1 | 3/2003 | Barrese et al. | |
| 6,554,184 | B1 | 4/2003 | Amos | |
| 6,704,039 | B2 | 3/2004 | Pena | |
| 6,705,448 | B1 | 3/2004 | Steel | |
| 6,736,251 | B2 * | 5/2004 | Molbak | 194/347 |
| 6,758,316 | B2 | 7/2004 | Molbak et al. | |
| 6,854,581 | B2 | 2/2005 | Molbak et al. | |
| 6,976,570 | B2 | 12/2005 | Molbak et al. | |
| 7,028,827 | B1 | 4/2006 | Molbak et al. | |
| 7,113,929 | B1 | 9/2006 | Beach et al. | |
| 7,290,645 | B2 | 11/2007 | Hill et al. | |
| 7,303,119 | B2 | 12/2007 | Molbak | |
| 7,527,193 | B2 | 5/2009 | Molbak | |
| 2002/0026423 | A1 | 2/2002 | Maritzen et al. | |

FOREIGN PATENT DOCUMENTS

| | | |
|---|---|---|
| CA | 2060630 | 11/1992 |
| CA | 2067987 | 11/1992 |
| CH | 680171 | 6/1992 |
| DE | 660354 | 5/1938 |
| DE | 25 28 735 | 9/1976 |
| DE | 30 21 327 | 12/1981 |
| DE | 3147603 | 6/1983 |
| EP | 0313294 | 4/1989 |
| EP | 0 351 217 | 1/1990 |
| EP | 0 420 163 | 4/1991 |
| EP | 0 477 722 | 4/1992 |
| EP | 0857579 | 8/1998 |
| EP | 0 924 662 | 6/1999 |
| EP | 0 924 664 | 6/1999 |
| EP | 0 924 665 | 6/1999 |
| EP | 1178448 | 2/2002 |
| FR | 2 042 254 | 2/1971 |
| FR | 2 342 531 | 9/1977 |
| FR | 2845189 | 4/2004 |
| GB | 958741 | 5/1964 |
| GB | 1564723 | 4/1980 |
| GB | 2095452 | 9/1982 |
| GB | 2121582 | 12/1983 |
| GB | 2153128 | 8/1985 |
| GB | 2175427 | 11/1986 |
| GB | 2186411 | 8/1987 |
| GB | 2188467 | 9/1987 |
| GB | 2198274 | 6/1988 |
| GB | 2 223 872 | 4/1990 |
| GB | 2223340 | 4/1990 |
| GB | 2255666 | 11/1992 |
| JP | 52-49892 | 4/1977 |
| JP | 52-50296 | 4/1977 |
| JP | 1-258092 | 10/1989 |
| JP | 1-307891 | 12/1989 |
| JP | 0081193 | 3/1990 |
| JP | 3-63795 | 3/1991 |
| JP | 3-92994 | 4/1991 |
| JP | 403252795 | 11/1991 |
| JP | 4-315288 | 11/1992 |
| JP | 4-344995 | 12/1992 |
| SE | 44-244 | 9/1918 |
| SE | 44-247 | 9/1918 |
| SE | 50-250 | 11/1919 |
| SE | 8801851 | 11/1989 |
| WO | WO-94/06101 | 3/1994 |
| WO | WO-94/09440 | 4/1994 |
| WO | WO-95/30215 | 11/1995 |
| WO | WO-96/30877 | 10/1996 |
| WO | WO-99-50785 | 10/1999 |
| WO | WO-00-10138 | 2/2000 |

OTHER PUBLICATIONS

Complaint for Patent Infringement; Filed Sep. 19, 2007; Civil Case No. 1:07-cv-05285; *Coinstar, Inc.* v. *Scan Coin North America, Inc.*; U.S. District Court for the Northern District of Illinois, Eastern Division; 24 pages.

Defendant Scan Coin North America's Motion to Dismiss Plaintiff's Complaint or, in the Alternative, to Stay Pending Resolution of Arbitration; Filed Oct. 31, 2007; Civil Case No. 1:07-cv-05285; *Coinstar, Inc.* v. *Scan Coin North America, Inc.*; U.S. District Court for the Northern District of Illinois, Eastern Division; 3 pages.

Brief in Support of Defendant Scan Coin North America's Motion to Dismiss Plaintiff's Complaint or, in the Alternative, to Stay Pending Resolution of Arbitration; Filed Oct. 31, 2007; Civil Case No. 1:07-cv-05285; *Coinstar, Inc.* v. *Scan Coin North America, Inc.*; U.S. District Court for the Northern District of Illinois, Eastern Division; 76 pages.
Scan Coin Industries AB'S Motion to Intervene as of Right or, Alternatively, to Permissively Intervene; Filed Oct. 31, 2007; Civil Case No. 1:07-cv-05285; *Coinstar, Inc.* v. *Scan Coin North America, Inc.*; U.S. District Court for the Northern District of Illinois, Eastern Division; 3 pages.
Scan Coin Industries AB'S Memorandum of Law in Support of Its Motion to Intervene as of Right or, Alternatively, to Permissively Intervene; Filed Oct. 31, 2007; Civil Case No. 1:07-cv-05285; *Coinstar, Inc.* v. *Scan Coin North America, Inc.*; U.S. District Court for the Northern District of Illinois, Eastern Division; 82 pages.
Plaintiff Coinstar, Inc.'s Opposition to Defendant's Motion to Dismiss or, in the Alternative, to Stay Pending Resolution or Arbitration; Filed Nov. 16, 2007; Civil Case No. 1:07-cv-05285; *Coinstar, Inc.* v. *Scan Coin North America, Inc.*; U.S. District Court for the Northern District of Illinois, Eastern Division; 57 pages.
Scan Coin North America's Reply to Coinstar's Opposition to Motion to Dismiss or, in the Alternative, to stay Pending Resolution of Arbitration; Filed Nov. 30, 2007; Civil Case No. 1:07-cv-05285; *Coinstar, Inc.* v. *Scan Coin North America, Inc.*; U.S. District Court for the Northern District of Illinois, Eastern Division; 24 pages.
Scan Coin Industries AB's Motion to Stay Pending Resolution of Arbitration; Filed Nov. 30, 2007; Civil Case No. 1:07-cv-05285; *Coinstar, Inc.* v. *Scan Coin North America, Inc.*; U.S. District Court for the Northern District of Illinois, Eastern Division; 3 pages.
Scan Coin Industries AB's Memorandum of Law in Support of its Motion to Stay; Filed Nov. 30, 2007; Civil Case No. 1:07-cv-05285; *Coinstar, Inc.* v. *Scan Coin North America, Inc.*; U.S. District Court for the Northern District of Illinois, Eastern Division; 13 pages.
Plaintiff Coinstar, Inc.'s Opposition to Scan Coin Industries AB's Motion to Stay; Filed Dec. 21, 2007; Civil Case No. 1:07-cv-05285; *Coinstar, Inc.* v. *Scan Coin North America, Inc.*; U.S. District Court for the Northern District of Illinois, Eastern Division; 13 pages.
Scan Coin Industries AB's Reply in Support of its Motion to Stay; Filed Jan. 9, 2008; Civil Case No. 1:07-cv-05285; *Coinstar, Inc.* v. *Scan Coin North America, Inc. ans Scan Coin Industries AB*; U.S. District Court for the Northern District of Illinois, Eastern Division; 273 pages.
Scan Coin Industries AB's Complaint in Intervention; Filed Jan. 16, 2008; Civil Case No. 1:07-cv-05285; *Coinstar, Inc.* v. *Scan Coin North America, Inc.*; *Scan Coin Industries AB* v. *Coinstar, Inc.*; U.S. District Court for the Northern District of Illinois, Eastern Division; 7 pages.
Information Disclosure Statement received by the USPTO on Feb. 17, 2004 in U.S. Appl. No. 10/670,111.
Information Disclosure Statement received by the USPTO on Dec. 18, 2006 in U.S. Appl. No. 10/670,111.
Scan Coin AB, "Scan Coin 4000 Value Sorter" and product photos, on sale in the U.S. prior to Sep. 2001.
Scan Coin 4000 Value Sorter, Operator's Instruction Manual, published before Sep. 2001.
SC4000 Coin Discriminating System, Including Perforated, Vibrating Coin Feeding and Cleaning Tray Assembly; on sale in the US by Scan Coin Since at least as early as Dec. 1994 (including photographs, drawings and parts lists).
Scan Coin 4000 Value Sorter Operator's Instruction Manual—1995.
Scan Coin SC4000 Operating Instructions, dated Aug. 10, 1994.
Scan Coin Technical Manual SC4000, dated Jul. 29, 1994.
Cohen, P., "Coinstar Turns Loose Change into iTunes Songs," Yahoo News, http://news.yahoo.com/s/macworld/20060410/tc_macworld/coinstar20060410_0, Apr. 10, 2006, pp. 1-3.
Sheehan, Michael, "Marriage of Convenience," 3 pages.
Answer to Amended Complaint for Patent Infringement and Counterclaim for Declaratory Judgment; Case No. C-97 20536 E.I.; United States District Court, Northern District of California, San Jose Division; filed Nov. 2, 1998, 11 pages.
Australian Patent Office, Examiner's First Report, May 11, 1999, Australian Application No. 71948/98, 2 pages.
Cash, M., "Bank blends new technology with service," Winnipeg Free Press, Sep. 4, 1992, 1 page.
Coinbank Automated Systems, Inc.'s Response to Coinstar Inc.'s Third Set of Interrogatories; *Coinstar, Inc.* v. *Coinbank Automated Systems, Inc.*; Case No. C-97 20536 EAI; United States District Court for the Northern District of California, San Jose Division; filed Mar. 15, 1999.
*Coinstar* v. *CoinBank Automated Systems, Inc.*; Case No. C-97 20536 E.I.; United States District Court, Northern District of California, San Jose Division; Defendant's Notice of Motion and Motion for Summary Judgment or Summary Adjudication of Issues: and Memorandum of Points and Authorities in Support Thereof and attachments; filed Jun. 7, 1999.
Leitch, C., "High-tech bank counts coins," Innovations, Report on Business, Sep. 16, 1991.
Oxby, M., "Royal Bank opens 'super branch," The Gazette Montreal, Sep. 14, 1991.
Scan Coin Technical Manual CDS MK 1 Coin Deposit System; 1991, pp. 1-31.
Scan Coin Technical Reference Manual CDS Coin Deposit System (odd pages only), 1989.
Super Branch Literature, Feb. 1992, 2 pages.
Technical Manual Cash Deposit System CDS 600 and CDS 640, 1991, 45 pages.
Civil, Docket for Case #: 3:06-cv-00299; *Coinstar, Inc.* v. *Coinxchange, LLC*; U.S. District Court, Eastern District of Virginia (Richmond); 10 pages.
Complaint for Patent Infringement; Filed May 2, 2006; Civil Case No. 3:06-cv-00299; United States District Court, Eastern District of Virginia, Alexandria Division; 89 pages.
Defendant's Answer and Counterclaims to Plaintiff's Complaint for Patent Infringement; Filed May 30, 2006; Civil Case No. 3:06-cv-00299; United States District Court, Eastern District of Virginia, Richmond Division, 13 pages.
Third Party Complaint of Coin X Change; Filed Jun. 13, 2006; Civil Case No. 3:06-cv-00299; United States District Court, Eastern District of Virginia, Richmond Division; 6 pages.
Memorandum in Support of Coin X Change's Motion to Expedite Proceedings; Filed Jun. 14, 2006; Civil Case No. 3:06-cv-00299; United States District Court, Eastern District of Virginia, Richmond Division; 31 pages with exhibits.
Plaintiff Coinstar, Inc.'s Reply to Counterclaims; Filed Jun. 20, 2006; Civil Case No. 3:06-cv-00299; United States District Court, Eastern District of Virginia, Richmond Division; 6 pages.
Cummins-Allison Corporation's Answer to Third-Party Complaint of Coin X Change; Filed Jun. 30, 2006; Civil Case No. 3:06-cv-00299; United States District Court, Eastern District of Virginia, Richmond Division; 17 pages.
Cummins-Allison's Memorandum in Support of its Motion for Summary Judgment on Counts I-III of Coin X Change's Third Party Complaint; Filed Jun. 30, 2006'; Civil Case No. 3:06-cv-00299; United States District Court, Eastern District of Virginia, Richmond Division; 77 pages.
Coin X Change's Opposition to Cummins' Statement of Undisputed Facts; Filed Jul. 11, 2006; Civil Case No. 3:06-cv-00299; United States District Court, Eastern District of Virginia, Richmond Division; 14 pages.
Coin X Change's Opposition to Cummins' Motion for Summary Judgment; Filed Jul. 11, 2006; Civil Case No. 3:06-cv-00299; United States District Court, Eastern District of Virginia, Richmond Division; 82 pages with exhibits.
Plaintiff Coinstar, Inc.'s Response to Coin X Change's Opposition to Motion for Summary Judgment; Filed Jul. 14, 2006; Civil Case No. 3:06-cv-00299; United States District Court, Eastern District of Virginia, Richmond Division; 5 pages.
Cummins-Allison's Reply Brief in Support of its Motion for Summary Judgment on Counts I-III of Coin X Change's Third Party Complaint; Filed Jul. 14, 2006; Civil Case No. 3:06-cv-00299; United States District Court, Eastern District of Virginia, Richmond Division; 29 pages.
Memorandum Opinion; Entered Jul. 28, 2006; Civil Case No. 3:06-cv-00299; United States District Court, Eastern District of Virginia, Richmond Division; 9 pages.
Order Granting Third Party Dft Cummins-Allison's Motion for Summary Judgment with respect to Counts I and II of Coin X Change's Third Party Complaint; Entered Jul. 28, 2006; Civil Case No. 3:06-cv-00299; United States District Court, Eastern District of Virginia, Richmond Division; 1 page.
Final Order re Third Party Complaint Only; Entered on Aug. 2, 2006; Civil Case No. 3:06-cv-00299; United States District Court, Eastern District of Virginia, Richmond Division; 1 page.
Stipulation Dismissing '402 and '972 Patents; Entered Nov. 3, 2006; Civil Case No. 3:06-cv-00299; United States District Court, Eastern District of Virginia, Richmond Division; 2 pages.
Defendant's Prior Art Statement; Filed Nov. 14, 2006; Civil Case No. 3:06-cv-00299; United States District Court, Eastern District of Virginia, Richmond Division; 75 pages.
Plaintiff Coinstar, Inc.'s Memorandum in Support of Proposed Claim Constructions; Filed Nov. 29, 2006; Civil Case No. 3:06-cv-00299; United States District Court, Eastern District of Virginia, Richmond Division; 161 pages with exhibits.
Coin X Change's Statement Regarding Extrinsic Evidence; Filed Nov. 29, 2006; Civil Case No. 3:06-cv-00299; United States District Court, Eastern District of Virginia, Richmond Division; 35 pages with exhibits.
Coin X Change's Claim Interpretation Statement; Filed Nov. 29, 2006; Civil Case No. 3:06-cv-00299; United States District Court, Eastern District of Virginia, Richmond Division; 15 pages.
Coin X Change's Claim Construction Memorandum; Filed Nov. 29, 2006; Civil Case No. 3:06-cv-00299; United States District Court, Eastern District of Virginia, Richmond Division; 144 pages with exhibits.
Stipulation Consenting to Amended Pleading and Joint Motion for Additional Non-Party Depositions; Entered Dec. 1, 2006; Civil Case No. 3:06-cv-00299; United States District Court, Eastern District of Virginia, Richmond Division; 20 pages.
Defendant's First Amended Answer and Counterclaims to Plaintiff's Complaint for Patent Infringement; Filed Dec. 1, 2006; Civil Case No. 3:06-cv-00299; United States District Court, Eastern District of Virginia, Richmond Division; 20 pages.
Order regarding the construction of claim terms in Patent No. 6,976,570 and 7,028,827; Entered Dec. 21, 2006; Civil Case No. 3:06-cv-00299; United States District Court, Eastern District of Virginia, Richmond Division; 7 pages.
Plaintiff Coinstar, Inc.'s Reply to Amended Counterclaims; Filed Dec. 21, 2006; Civil Case No. 3:06-cv-00299; United States District Court, Eastern District of Virginia, Richmond Division; 7pages.
Scan Coin User's Manual, CDS 600, 1991, 14 pages.
Technical Manual, Cash Deposit System, Model CDS 600 & CDS 640, 1991, 46 pages.
"Kunderna fixar vaxeln," Praktiska, 2 pages.
Svenska Penninglotteriet Documents, 1988, 46 pages.
Fri Kopenskap articles, Mar. 18, 1988, Apr. 27, 1989 and Nov. 25, 1988, 4 pages.
Priab Prisma article, 1989, 7 pages.
Scan Coin CDS Cash Deposit System, Brochure, Sep. 1988, 6 pages.
Scan Coin CDS Mini Cash Deposit System, Brochure, Undated, 2 pages.
Scan Coin 102 Value Counter, Brochure, Undated, 2 pages.
Scan Coin CDS 600 Cash Deposit System, Brochure, Undated, 2 pages.
Svenska Penninglotteriet Documents, 1988, 68 pages.
Civil Docket for Case #: 1:07-cv-05285; *Coinstar, Inc.* v. *Scan Coin North America, Inc.*; U.S. District Court for the Northern District of Illinois, Eastern Division; 6 pages.
Opinion and Order Denying Scan Coin North America's Motion to Dismiss and Granting Scan Coin Industries AB's Motion to Stay; Entered on Jul. 9, 2008; Civil Case No. 1:07-cv-05285; *Coinstar, Inc.* v. *Scan Coin North America, Inc and Scan Coin Industries AB*; U.S. District Court for the Northern District of Illinois, Eastern Division; 9 pages.
Civil Docket for Case #: 3:06-cv-00299; *Coinstar, Inc.* v. *Coinxchange, LLC*; U.S. District Court, Eastern District of Virginia (Richmond); 16 pages.
Motion for Reconsideration or Clarification of Claim Construction Order; Filed Jan. 5, 2007; Civil Case No. 3:06-cv-00299; United States District Court, Eastern District of Virginia, Richmond Division; 64 pages.
Coin X Change's Opposition to Plaintiff's Motion for Reconsideration or Clarification of Claim Construction Order; Filed Jan. 16, 2007; Civil Case No. 3:06-cv-00299; United States District Court, Eastern District of Virginia, Richmond Division; 9 pages.
Expert Report of James A. Forstner; Filed Jan. 16, 2007; Civil Case No. 3:06-cv-00299; United States District Court, Eastern District of Virginia, Richmond Division; 47 pages.
Affirmative Expert Report of James A. Fox Regarding Invalidity of U.S. Patent Nos. 6,976,570 and 7,028,827; Filed Jan. 16, 2007; Civil Case No. 3:06-cv-00299; United States District Court, Eastern District of Virginia, Richmond Division; 40 pages.
Affirmative Expert Report of Patrick McDaniel, Ph.D., Regarding the Invalidity of U.S. Patent No. 6,976,570; Filed Jan. 16, 2007; Civil Case No. 3:06-cv-00299; United States District Court, Eastern District of Virginia, Richmond Division; 39 pages.
Coinstar, Inc.'s Reply Memorandum in Support of Motion for Reconsideration or Clarification of Claim Construction Order; Filed Jan. 19, 2007; Civil Case No. 3:06-cv-00299; United States District Court, Eastern District of Virginia, Richmond Division; 8 pages.
Order for Coinstar's Motion for Reconsideration or Clarification of Claim Construction Order; Filed Jan. 23, 2007; Civil Case No. 3:06-cv-00299; United States District Court, Eastern District of Virginia, Richmond Division; 2 pages.
Supplemental Expert Report of Patrick McDaniel, Ph.D., Regarding the Invalidity of U.S. Patent No. 6,976,570; Filed Feb. 14, 2007; Civil Case No. 3:06-cv-00299; United States District Court, Eastern District of Virginia, Richmond Division; 7 pages.
Supplemental Affirmative Expert Report of James Fox Regarding Invalidity of U.S. Patent Nos. 6,976,570 and 7,028,827; Filed Feb. 14, 2007; Civil Case No. 3:06-cv-00299; United States District Court, Eastern District of Virginia, Richmond Division; 7 pages.
Responsive Expert Report of James Fox Regarding Non-Infringement of U.S. Patent Nos. 6,976,570 and 7,028,827; Filed Feb. 15, 2007; Civil Case No. 3:06-cv-00299; United States District Court, Eastern District of Virginia, Richmond Division; 29 pages.
Expert Report of Pete Abell; Filed Feb. 15, 2007; Civil Case No. 3:06-cv-00299; United States District Court, Eastern District of Virginia, Richmond Division; 24 pages.
Rebuttal Expert Report of Adil S. Said Regarding Validity of U.S. Patent Nos. 6,976,570 and 7,028,827; Filed Feb. 16, 2007; Civil Case No. 3:06-cv-00299; United States District Court, Eastern District of Virginia, Richmond Division; 32 pages.
Rebuttal Expert Report of Patrick McDaniel, Ph.D., Regarding the Invalidity of U.S. Patent No. 6,976,570; Filed Mar. 2, 2007; Civil Case No. 3:06-cv-00299; United States District Court, Eastern District of Virginia, Richmond Division; 13 pages.
Rebuttal Expert Report of Professor Larry G. Richards, Regarding Infringement of U.S. Patent Nos. 6,976,570 and 7,028,827; Filed Mar. 2, 2007; Civil Case No. 3:06-cv-00299; United States District Court, Eastern District of Virginia, Richmond Division; 7 pages.
Coinstar, Inc.'s Motion for Summary Judgment on Issues of Infringement and Unfair Competition; Filed Mar. 7, 2007; Civil Case No. 3:06-cv-00299; United States District Court, Eastern District of Virginia, Richmond Division; 43 pages.
Rebuttal Expert Report of James Fox Regarding Invalidity; Filed Mar. 8, 2007; Civil Case No. 3:06-cv-00299; United States District Court, Eastern District of Virginia, Richmond Division; 36 pages.
Rebuttal Expert Report of James A. Forstner; Filed Mar. 8, 2007; Civil Case No. 3:06-cv-00299; United States District Court, Eastern District of Virginia, Richmond Division; 25 pages.
Stipulated Order for Permanent Injunction and Dismissal; Filed Apr. 9, 2007; Civil Case No. 3:06-cv-00299; United States District Court, Eastern District of Virginia, Richmond Division; 2 pages.
Notice of Recordation of Assignment Document and Recordation Cover Sheet; Filed by Scan Coin Industries AB for certain Coinstar patent applications and patents; Patent Application No. 11/336,413; Recorded on Oct. 22, 2008; 6 pages.
Notice of Claim of Ownership plus related Exhibits A, B, and C, 70 pages.
Notice of Allowance and Fee(s) Due; U.S. Appl. No. 11/923,592; Mailed on Feb. 4, 2009; 6 pages.
Non-Final Office Action; U.S. Appl. No. 11/923,592; Mailed: Oct. 1, 2008; 8 pages.

Patent Report; Mailed to the USPTO on Sep. 20, 2007; Civil Case No. 1:07-cv-05285; *Coinstar, Inc.* v. *Scan Coin North America, Inc.*; U.S. District Court for the Northern District of Illinois, Eastern Division; 1 page.
Minute Entry Granting Scan Coin Industries AB's Motion to Intervene as of Right or, Alternatively, to Permissively Intervene; Entered on Nov. 27, 2007; Civil Case No. 1:07-cv-05285; *Coinstar, Inc.* v. *Scan Coin North America, Inc.*; U.S. District Court for the Northern District of Illinois, Eastern Division; 1 page.
Minute Entry; Docket entry for Coinstar's Response and Scan Coin Industries AB's Reply; Entered on Dec. 7, 2007; Civil Case No. 1:07-cv-05285; *Coinstar, Inc.* v. *Scan Coin North America, Inc.*; U.S. District Court for the Northern District of Illinois, Eastern Division; 1 page.
Sheehan, Michael, "Marriage of Convenience," 3 pages. http://www.kioskbusiness.com/NovDec01/articles/article4.html [accessed May 19, 2003].
Accessories Brochure, undated, 3 pages.
Bedienungsanleitung CDS 500/MCC 500, undated, 9 pages.
CDS Automated receipt giving cash deposit system, 3 pages.
CoinBank Automated Systems, Inc.'s Initial Disclosure of Prior Art Pursuant to Local Rule 16-7, Case No. C-97 20536 EA1, Nov. 20, 1997.
F. Zimmerman Co., "Reference Manual Contovit/Sortovit, Perconta Money Counting and Sorting Systems," Aug. 1995, pp. I-III, 1-31, and three pages of specifications.
Geldinstitute Literature, Mar. 1990 and Apr.-May 1992, 4 pages.
Hamilton, "Turning Cans into Cold Cash," The Washington Post, Jul. 2, 1991, pp. D1, D4.
Kundenselbstbedienung, undated, 4 pages.
Llemeon, J., "Royal's Burlington drive-in bank provides customers 24-hour tellers," Business Today, The Toronto Star, Aug. 21, 1991.
Order Granting Counter-Defendant's (1) Motion to Dismiss Counterclaim for Declaratory Judgment Based on Unenforceability and (2) Motion to Strike Inequitable Conduct Affirmative Defense, Ordered Sep. 8, 1997, No. C97-20536 EA1.
Reis Eurosystems Geldbearbeitungssysteme, "Test-Programme CS 3110 Selectronic coin sorting and counting machine", Jul. 1992, pp. 1-3.
Reis Eurosystems, "Operating Instructions CS 3110 Selectronic Coin Sorting and Counting Machine With Central Sensor", Jul. 1992, pp. 1-12, I-IV.
Scan Coin AB's Answers to Coinbank's First Set of Interrogatories (Nos. 1-13), executed on Nov. 3, 1997, 15 pages.
Scan Coin CDS 640 Cash Deposit System Brochure, 2 pages.
Scan Coin CDS Cash Deposit System, undated, 2 pages.
Scan Coin CDS Munzgeldeinzahlungen in Selbstbedienung: Cash Deponier System CDS 500, 1994, 6 pages.
Scan Coin correspondence regarding supermarkets, Sep. 11, 1992, 4 pages.
Scan Coin International Report Apr. 1987, 49 pages.
Scan Coin Money Processing Systems, Oct. 1, 1988, 10 pages.
Scan Coin Newsletter, May 1991, 2 pages.
Scan Coin Sales Invoices for Coin Counters in the United States, 1989-1993, 28 pages.
Scan Coin Technical Manual SC 102 Value Counter, undated, 28 pages.
Scan Coin World Newsletters, Scan Coin AB, Jagerhillgatan 26, S-213 75 Malmo, Sweden, 1988-1990, 6 pages.
Second Amended and Supplemental Answer to Complaint for Patent Infringement and Counterclaim for Declaratory Judgment, Dated Sep. 27, 1997, Case No. C-97 20536 EA1.
"Slide Changing Apparatus With Slide Jam Protection," Research Disclosure 30509, Sep. 1989.
Technical Specifications GBS9401 SB, undated, 24 pages.
User's Manual Scan Coin CDS 600, Dec. 12, 1990, 14 pages.
User's Manual Scan Coin CDS 640, 1988, 7 pages.
U.S. Appl. No. 12/412,142, filed Mar. 26, 2009, Molbak.
Non-Final Office Action for U.S. Appl. No. 12/412,142; Mailed Jul. 2, 2010; 41 pages.

* cited by examiner

COIN COUNTER/SORTER AND COUPON/VOUCHER DISPENSING MACHINE AND METHOD

CROSS REFERENCE TO RELATED APPLICATIONS

This application is a continuation of U.S. patent application Ser. No. 08/689,826, filed Aug. 12, 1996 now U.S. Pat. No. 7,028,827, which is a continuation of U.S. patent application Ser. No. 08/255,539, filed Jun. 6, 1994 (now U.S. Pat. No. 5,564,546), which is a continuation of U.S. application Ser. No. 07/940,931, filed Sep. 4, 1992, abandoned, which applications are incorporated herein in their entireties by reference.

BACKGROUND OF THE INVENTION

The present invention relates to coupon dispensing machines and coin sorting machines.

There are a variety of machines which dispense stamps, tickets, coupons, money orders, bank transactions or the like. One type of machine, shown in U.S. Pat. No. 5,039,848 to Raymond Stoken, dispenses coupons in exchange for money. A display area indicates the different coupons available as well as the specific amount of money required to obtain each particular coupon. Money is inserted into the machine via a coin slot. Control circuitry determines which coupon has been selected, the amount of money required to purchase this coupon, and if the correct amount of money has been inserted into the coin slot. The control circuitry then causes the coupon dispenser to dispense the requested coupon.

Other machines dispense other types of products. For instance, U.S. Pat. No. 5,021,967 to Lawrence Smith is a money order dispensing machine. This machine is meant to be operated by a system operator, not a customer, and therefore does not require the capability to receive money. The machine prints money orders on a dot matrix printer after receiving the necessary data inputs from the operator.

A different variety of machines has been patented which sort coins. One such machine, shown in U.S. Pat. No. 4,995,848 to David Goh uses two methods to sort coins, both methods based on the diameter of the coins. In this machine the coins are loaded into a hopper. A rotating wheel feeds the coins individually onto an inclined ramp. The coins roll down the ramp with their rear surfaces resting against a support surface. Specific denominations are selected when they fall through slots of varying size located in the support surface. Specific denominations are also selected using peeler knives which are arranged at different distances from the ramp surface. These knives topple the coins from the ramp into bins. Using both techniques allows a short ramp to be employed. Another type of machine shown in U.S. Pat. No. 4,059,122 to Yoshio Kinoshita counts the number of coins according to denomination after sorting the coins.

SUMMARY OF THE INVENTION

The present invention provides an apparatus which can receive a number of unsorted coins. The coins are sorted and counted to determine a total value. The user is issued a voucher for an amount related to the total value.

The present invention offers a valuable service to the retailer in whose store this machine is placed as well as to the actual user. People tend to collect coins at home, finding that carrying large quantities of coins is unwieldy and impractical. Furthermore, spending coins normally requires either placing the coins singularly into product dispensing machines or counting the coins out by hand. This invention allows the user to periodically exchange excess coins for cash vouchers. The user need not first count the coins since the present invention automatically counts the coins. The advantages to the retailer are numerous. First, although the voucher is exchangeable for cash or merchandise, most customers are likely to purchase goods at the store where they exchange their coins. Second, by offering a convenience to their customers, retailers gain the goodwill of these customers. Thus, the present invention provides a voucher issuing machine in which the amount of the voucher is not preset, and also allows coin sorting by a typical consumer.

In the preferred embodiment coins are placed in a hinged hopper tray built into one of the machine's surfaces. To activate the process the user presses a "go" button and then lifts one edge of the tray, causing the coins to fall down a chute to the high speed coin sorting and counting mechanism. Coins are counted and sorted by denomination and then dropped into a temporary holding area called an escrow tray. As the coins are counted, the total monetary value is displayed on a video screen as well as the number of coins counted within each denomination. After all of the coins have been counted, the user is asked to make a decision, either rejecting the transaction or allowing the transaction to proceed. If the transaction is rejected, the coins are returned to the user via a return chute. If the transaction is accepted, the coins are dropped into separate bins or trays based upon their denomination. This triggers the controller to print and dispense a cash voucher to the user via a slot in the machine's surface.

Besides exchanging cash vouchers for coins, in the preferred embodiment the invention dispenses manufacturers' coupons from a separate slot redeemable for various bargains. These coupons are dispensed at no cost to the user. A second type of coupon to be dispensed in the preferred embodiment are store coupons. These coupons are printed by the cash voucher printer and dispensed through the same slot as the cash vouchers and are good only for specific bargains unique to that store. For example, the store manager may have a surplus of a particular item and therefore wish to offer a "two-for-one" bargain for a limited time. Selected products and bargains may also be promoted on the video display. These promotional techniques have the advantage of being easily alterable; thus an individual store manager can tailor the store coupons/ads depending upon factors such as the time of day (e.g., midday grocery store shoppers versus after work shoppers versus late night shoppers) while the chain store owner can vary the store coupons/ads depending upon a particular store's location and needs (e.g., deli shop versus bakery shop versus floral shop).

Generally, in the prior art, coins are either inserted into a machine singularly, or in the case of large commercial sorting machines, by trained personnel. In the present invention, non-trained personnel will dump large amounts of coins into the hopper tray. These untrained users are likely to empty their personal containers, such as old cans or bottles, directly into the hopper without first inspecting the coins. Thus lint, tokens, and various other objects will probably accompany the coins into the machine. Therefore a method of waste management is necessary to insure that the machine is not damaged during use.

In the preferred embodiment, the user dumps coins into a hopper tray which doubles as an inspection area. The bottom of the hopper tray is perforated, thus allowing small foreign objects to fall through the perforations instead of entering the coin sorting mechanism. While the coins are in the hopper, the user has an opportunity to remove large foreign objects. After inspecting the coins, the user first presses a "go" button indicating they wish to use the machine, and then lifts one edge of the hinged tray, causing the coins to fall down a waste management chute. This chute leads to the coin sorting and counting mechanism. In the preferred embodiment, when the "go" button is pressed, the coin sorter starts, the coin counter is initialized, and a fan within the waste management chute is activated. The fan blows light weight debris, such as lint and dust, out of the chute and away from the coin counter/sorter mechanism. The bottom surface of the waste management chute is a grooved and porous plate which allows any fluids dumped into the machine to be removed from the coins and collected. This helps to avoid possible damage to the machine. Magnetic strips are placed along the entrance and exit areas of the chute to extract any magnetic tokens which may have been included with the coins.

Many people have an intrinsic distrust of machines, especially with regards to machines handling their money, and therefore it is desirable to quickly gain the user's trust. This invention has several features which accomplish this goal. First, the front of the machine is clear, encouraging user trust since the flow of coins can be watched throughout the process. Second, until the voucher is issued, the user is in control of the process. Prior to issuing the voucher the display indicates the amount of the coins counted. At this point the user can either agree with the amount and allow the transaction to proceed, or can reject the amount and have the coins returned. Until the user makes this decision, the coins are kept in a temporary holding area called an escrow tray. In the preferred embodiment, the basic escrow tray is immobile although the bottom surface of the tray can be manipulated. Through the manipulation of this surface, the coins are either returned to the user or dumped into a storage bin within the machine.

DETAILED DESCRIPTION OF THE SPECIFIC EMBODIMENT(S)

Figure 1:
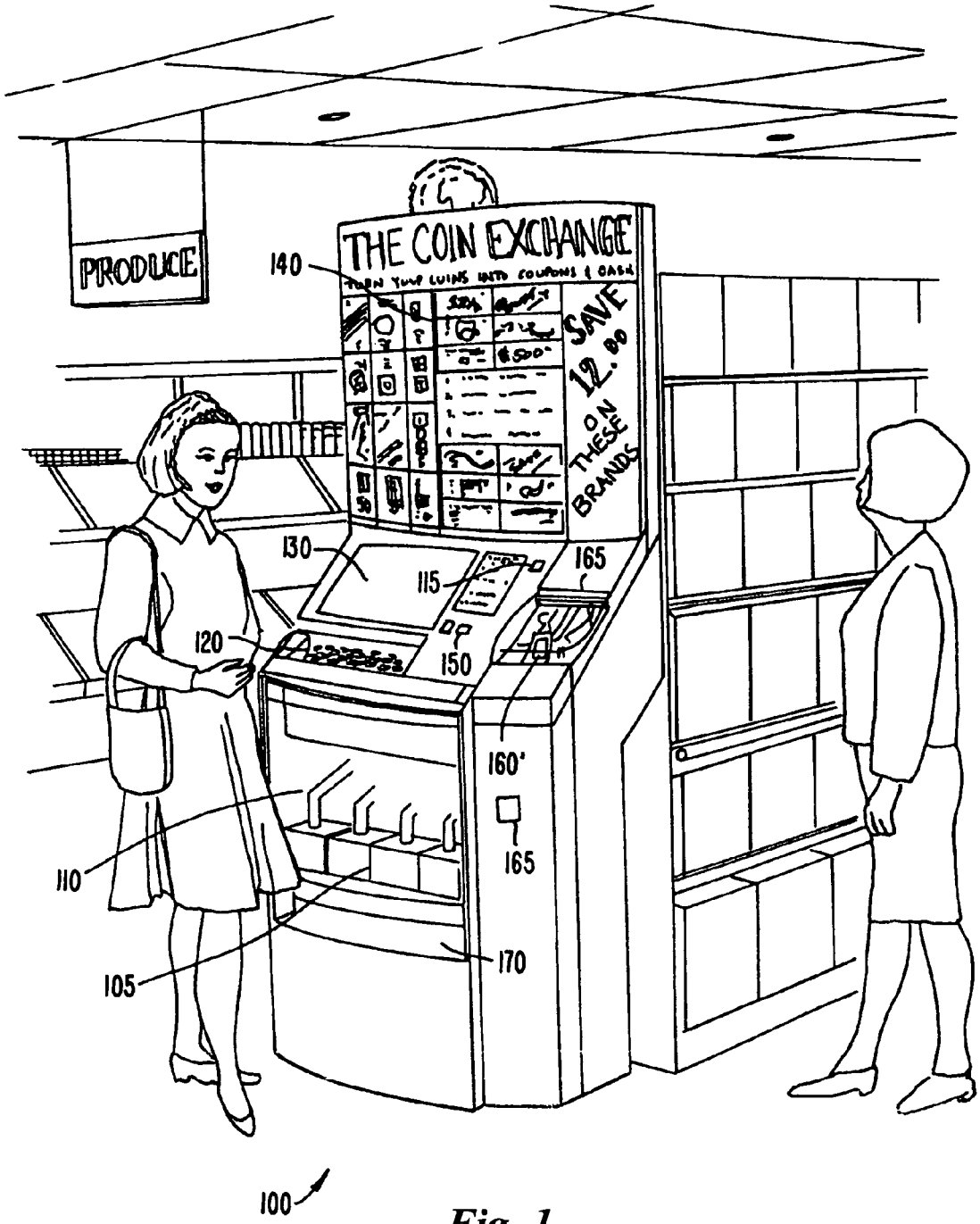
FIG. 1 is an illustration of an embodiment of the coin exchange apparatus in a likely environment.

FIG. 1 is an illustration of the coin exchange kiosk 100 in a possible environment; a supermarket. Kiosk 100 is free-standing, and has been designed with a small footprint to minimize the required floor space. The lower front surface 110 is clear, allowing the user to watch the coins as they are separated, counted, and dropped into escrow tray 105. By making the process visible to the user, trust in the machine is encouraged. Furthermore, since watching the sorting process is interesting, the user becomes integrated into the machine's operation and is further encouraged to use the machine.

Initially the coins are placed in coin tray 120 where small foreign objects fall through perforations in the bottom of the tray and the user can remove large foreign materials prior to coin sorting. When the user is ready to begin the sorting process, they must push "go" button 115. Button 115 initializes the coin counter, activates the coin sorter, and activates the fan within the waste management chute. If the system does not detect coins within a predetermined period of time, both the coin sorter and the fan are deactivated. The user next raises the edge of tray 120. The tray is hinged on the right side and acts as a chute to funnel the coins into the kiosk. User directions, transaction information, store bargains, and advertisements appear on video screen 130. Screen 130 can also be used to show attention getting displays in order to attract potential users. Once the coins are admitted into the kiosk and the go button has been pushed, the waste removal and coin sorting process begins. During the coin sorting process, coins which do not meet the necessary physical criteria are rejected and returned to the user via chute 165. In the preferred embodiment, as the coins are counted the video screen displays both the total monetary value and the number of coins collected within each denomination.

At the conclusion of the sorting process, the user is asked to either accept the stated coin value and continue the transaction, or cancel the transaction. This selection is made by pushing one of two buttons 150. If the user continues the transaction, then the coins in the escrow tray 105 are dumped into a depository and the user is issued a voucher through slot 160. In the preferred embodiment, the voucher is worth the value of the counted coins and is redeemable at the retailer's cashier for cash or credit towards purchases. Store coupons, printed by the voucher printer and good towards store bargains, are dispensed with the cash voucher. Manufacturers' coupons are dispensed through an adjoining slot 165 at no cost to the user. If the user cancels the transaction the coins are returned in area 170. The upper back portion 140 of kiosk 100 is a display board where advertisements and notices can be placed. Display board 140 can also be used to indicate what coupons the machine is currently dispensing.

Figure 2:
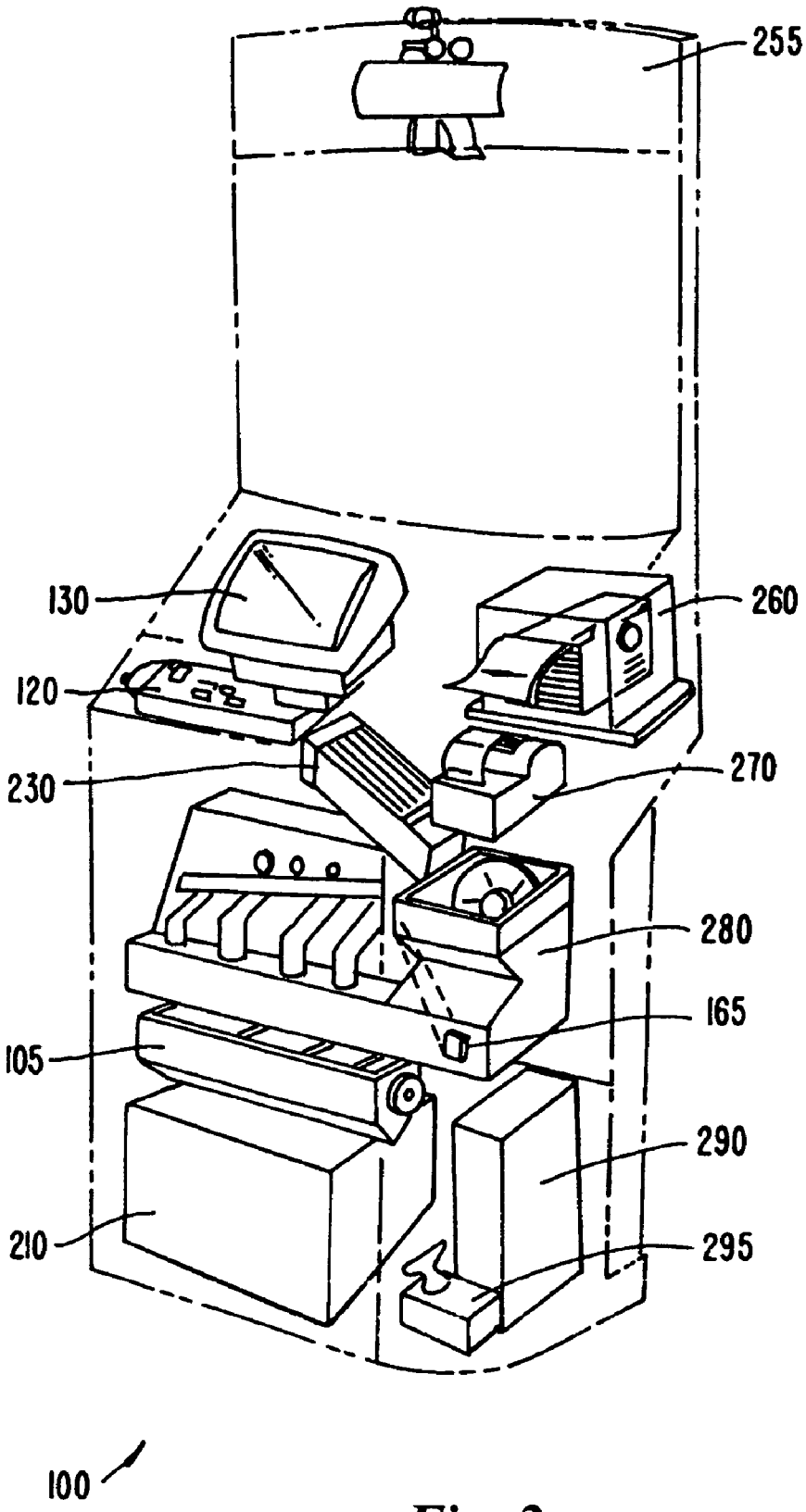
FIG. 2 is a diagram showing the internal layout of the principal components in the preferred embodiment.

The internal layout of kiosk 100 is shown in FIG. 2. The coin storage area 210 holds the coins after the transaction has been completed. Area 210 can either be separated into large capacity bins to hold each denomination, or into ready to use coin trays. When the storage area is close to capacity, an indicator 255 on the outside of the kiosk 100 notifies store personnel to empty the storage area 210.

The outside of the waste management system 230 is visible in this diagram. Liquids fall through the porous, grooved bottom plate of system 230 while lint and other fine materials are blown away by a small fan located in the chute. Liquids are collected in a waste receptacle. At the end of system 230, the coins are funneled into the coin counter and sorter 280. This is a commercially available sorter. Several manufacturers make suitable machines, although in the preferred embodiment a Scan Coin Model 109 with a modified hopper is used. The counter accepts mixed coins and is able to detect foreign coins and slugs. Rejected coins are returned to the user through chute 165.

Two different printers are used in the preferred embodiment of the kiosk. Printer 270 is used to print the cash vouchers and the store coupons. The preferred embodiment uses an Epson TM267 printer. Besides containing the amount of the voucher, the voucher will also contain other information such as store name, transaction number, bar codes, etc in order to make counterfeiting difficult. Special papers and inks can also be used to discourage counterfeiting. In the preferred embodiment, a separate printer 295 makes a continuous record of each transaction. This printer is an Epson RP265. In a second embodiment printer 270 serves a double function. Besides printing the vouchers, upon command by store personnel this printer prints out all of the pertinent transactional information. CPU 290 also stores this information.

In the preferred embodiment, VGA screen 250 is a Super VGA monitor; CPU 290 is a Belmont, 386, 40 MHz CPU; and high capacity sheet feeder 260 is a modified 1000 sheet feeder manufactured by Gradco, model number HCF-1000. Warning light 255 warns store personnel when either printer is low on paper, the sheet feeder is low on paper, or there has been a system malfunction.

Figure 3:
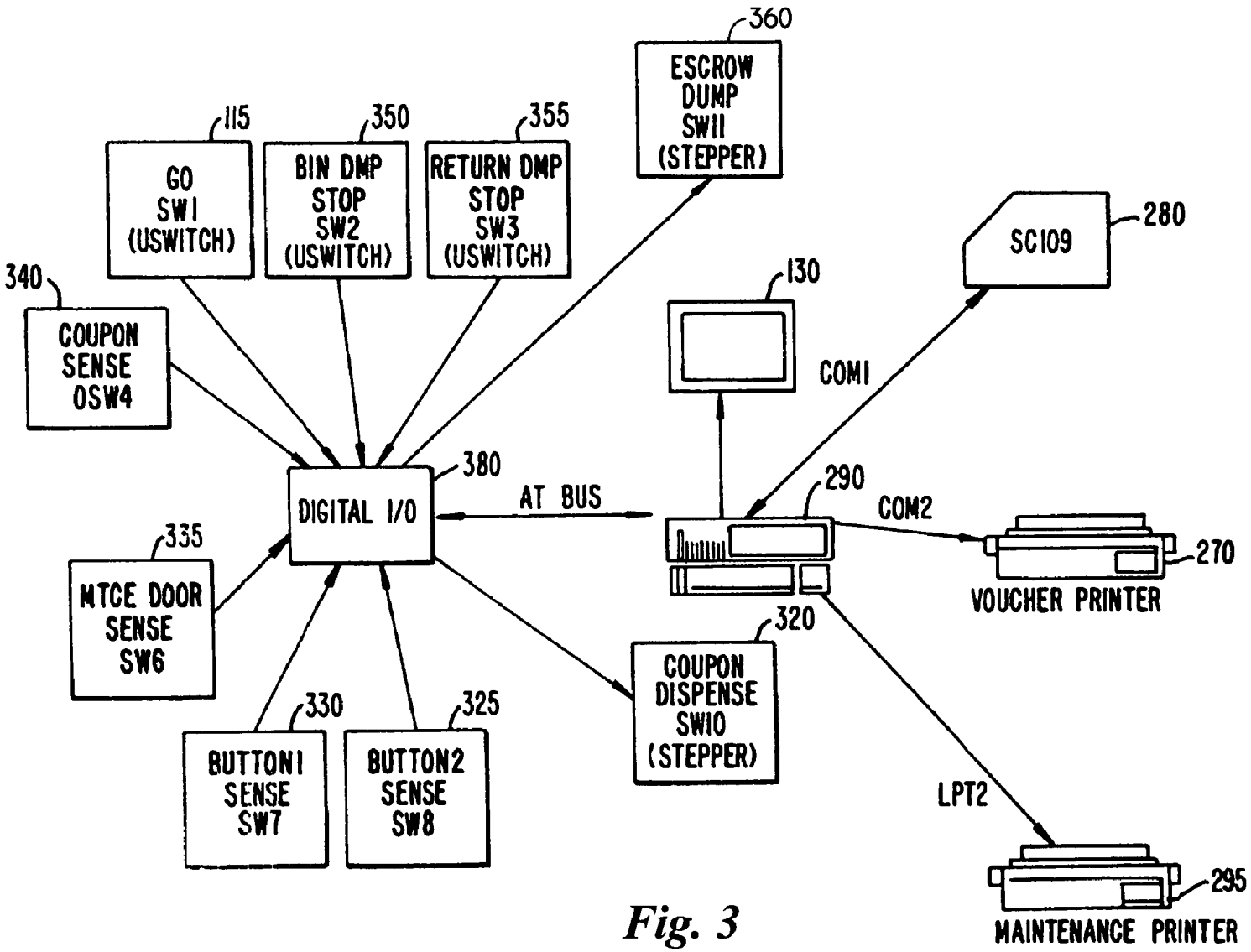
FIG. 3 is a block diagram of the system level electronic functions.

FIG. 3 is a block diagram of the system level electronic functions. The entire system is controlled by CPU 290. System information is presented on display 130 which is the same monitor used to communicate with the user. System inputs are coupled to CPU 290 via data bus 380. Push button switches 330 and 325 are used by the user to either accept or cancel the transaction. Switch 335 is a maintenance switch which is used by store personnel to command the system to download system information to either the maintenance printer 295 or to a floppy disk. The maintenance switch may also be used to enter a mode to allow clearing of coin jams and an internal store coin counting mode. This internal store coin counting mode will enable the retailer to sort and count coins from vending machines and cash registers, bypassing the voucher and coupon functions. Leading edge sensor 340 tells the system each time a sheet of coupons has been dispensed. Stepping motor 320 dispenses the coupon sheets. Push button switch 115 is depressed by the user to initialize the counting system and activate both the coin counter/sorter 280 and the waste management fan. Microswitches 350 and 355 deactivate escrow tray stepping motor 360, thus preventing possible mechanical damage by the stepping motor moving the tray past its designated limits, and indicate to CPU 290 the position of the escrow tray (i.e., at-rest position, returning coins to the user position, or dumping coins into the machine's storage area position). CPU 290 also controls the voucher printer 270.

Figure 4:
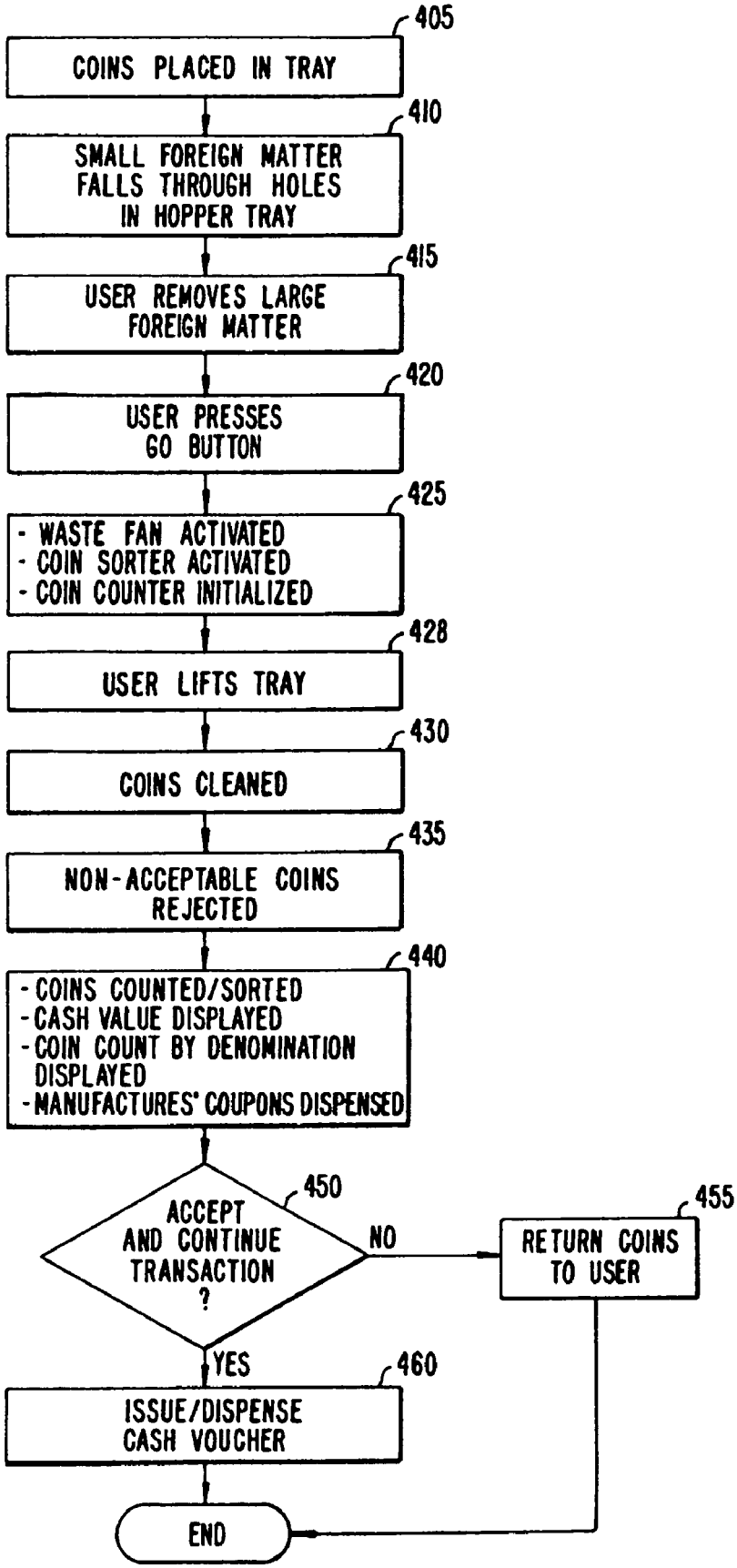
FIG. 4 is a flow chart of the operation of the system.

The flowchart of FIG. 4 illustrates the operation of the coin exchange kiosk in its preferred embodiment. The user places coins of varying denominations into the external tray (step 405). Small foreign matter falls through perforations in the bottom of the hopper tray (step 410) while large foreign matter is removed by the user (step 415). When the user is ready to begin using the machine, they press the "go" button (step 420). Pressing the go button activates the coin sorter, initializes the coin counter, and activates the fan within the waste management chute (step 425). Next the user lifts the edge of the hopper tray, dumping the coins down the entrance chute of the waste management system (step 428). As the coins go through the waste management system certain waste, such as liquids, are removed (step 430). The coins are then counted and sorted (step 440). During this step coins which do not meet the necessary physical criteria are rejected and returned to the user (step 435). As the coins are counted, the value of the coins is displayed on the monitor as well as the number of coins counted within each denomination (step 440). Manufacturers' coupons are dispensed at this time (step 440). After all of the coins are counted, the user is asked to either accept the value that has been determined and continue the transaction or to reject the value and discontinue the transaction (step 450). If the user decides to reject the stated value then the coins are returned (step 455). If the user decides to accept the stated value and continue the transaction then a cash voucher is dispensed for the stated value (step 460).

Figure 5:
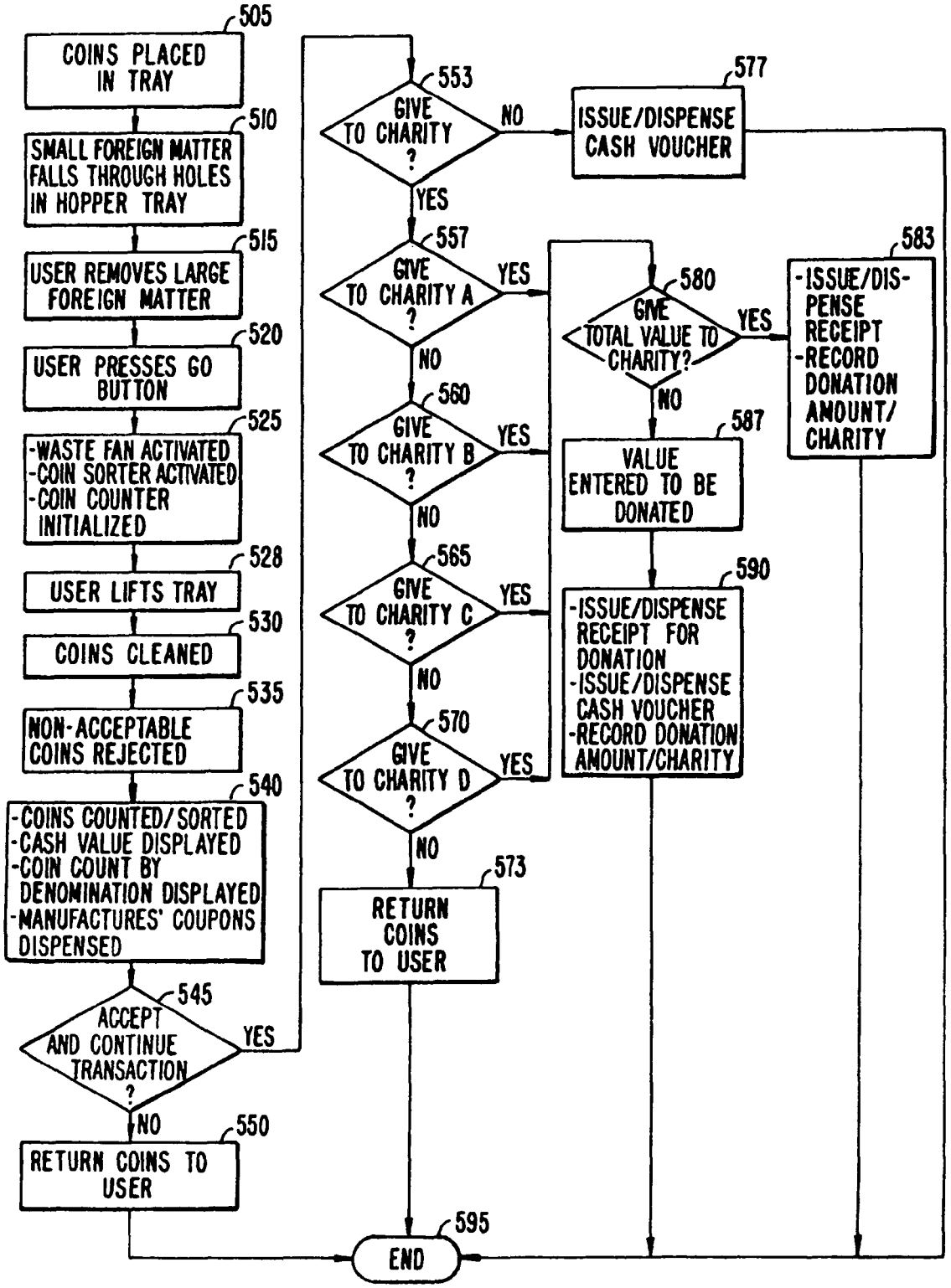
FIG. 5 is a flow chart of the operation of a second embodiment of the system.

The flowchart of FIG. 5 illustrates the operation of the coin exchange kiosk in a second embodiment. The user places coins of varying denominations into the external tray (step 505). Small foreign matter falls through perforations in the bottom of the hopper tray (step 510) while large foreign matter is removed by the user (step 515). When the user is ready to begin using the machine, they press the "go" button (step 520). Pressing the go button activates the coin sorter, initializes the coin counter, and activates the fan within the waste management chute (step 525). Next the user lifts the edge of the hopper tray, dumping the coins down the entrance chute of the waste management system (step 528). As the coins go through the waste management system certain waste, such as liquids, are removed (step 530). The coins are then counted and sorted (step 540). During this step coins which do not meet the necessary physical criteria are rejected and returned to the user (step 535). As the coins are counted, the value of the coins is displayed on the monitor as well as the number of coins counted within each denomination (step 540). Manufacturers' coupons are dispensed at this time (step 540). After all of the coins are counted, the user is asked to either accept the value that has been determined and continue the transaction or to reject the value and discontinue the transaction (step 545). If the user decides to reject the stated value then the coins are returned (step 550) and the transaction ends (step 595).

If the user decides to accept the stated value and continue the transaction then they are asked whether they would like to donate, in whole or in part, the value of the coins to a charity (step 553). If the user does not wish to donate to a charity then a cash voucher is issued (step 577) and the transaction ends (step 595). If the user wishes to donate to a charity, then the user is asked to chose to which charity they wish to donate (steps 557, 560, 565, and 570). If they do not wish to donate to any of the listed charities, then the transaction ends (step 595) and the coins are returned (step 573).

After choosing to which charity they wish to donate, the user is asked if they wish to donate the total value of the coins (step 580). If the user wishes to donate the total amount then a receipt is issued which states the amount and the charity (step 583). CPU 290 records the amount donated and the charity (step 583) so that when the coins are removed from kiosk 100 the proper amounts can be deposited to the appropriate charity organizations. If the user selects to donate only a portion of the total amount, they then enter the amount to be donated (step 587). At this point a receipt for the donated portion is issued, a cash voucher for the remainder of the total amount is issued, and CPU 290 records the amount donated and the charity for later disbursement of funds (step 590).

Figure 6:
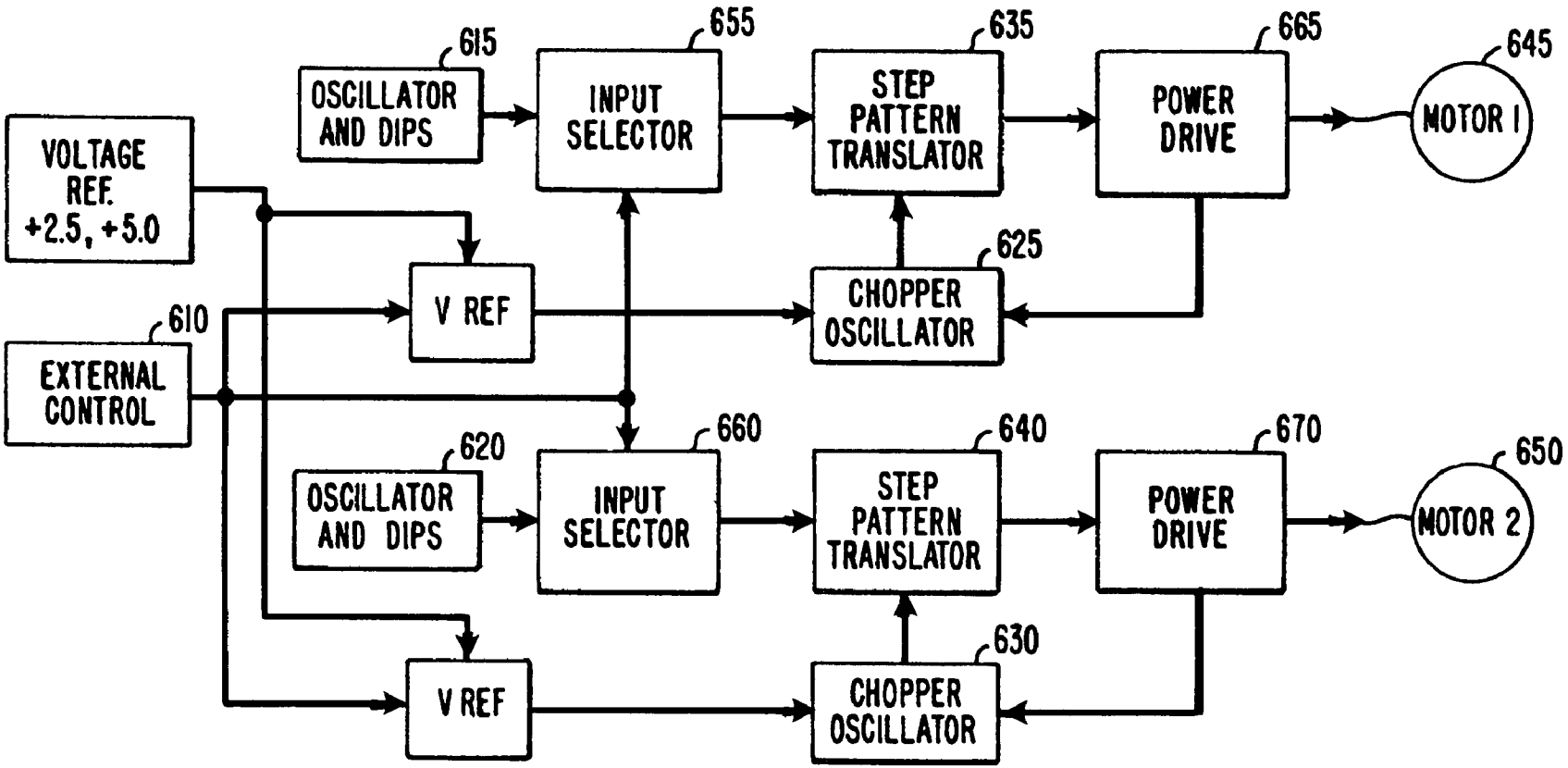
FIG. 6 is a block diagram of the stepping motor control circuitry.

FIG. 6 is a block diagram of the stepping motor control circuitry for the two stepping motors used in kiosk 100. One stepping motor controls the coupon dispenser and the other stepping motor controls the escrow tray. The circuitry for the two motors are duplicates of one another. The oscillators in blocks 615 and 620 generate the pulses which set the stepping motor rates. The dip switches in blocks 615 and 620 allow manual setting of the oscillator rates. Each motor has a second oscillator, blocks 625 and 630, which set the chopping rate. The step pattern translators, blocks 635 and 640, use both oscillators to generate the step motor patterns. Two different oscillators are used in order to maximize the power efficiency.

In operation, computer 290 determines when power should be supplied to either the coupon dispenser stepping motor 645 or the escrow tray stepping motor 650. This input is supplied via interface 610. This signal is received by either input selector 655 or 660. In the preferred embodiment, this signal is digital. Depending upon the signal, the selector determines the length of time the stepping motor will be operated. For example, one signal from interface 610 will cause the coupon dispenser (motor 645) to dispense only a single sheet of coupons while a different signal will cause two sheets of coupons to be dispensed. Similarly, one signal from interface 610 will cause the escrow tray (motor 650) to rotate in one direction thereby returning coins to the user, while a different signal will cause the opposite motor rotation thereby depositing the coins into the coin receptacle. The power drive units 665 and 670 supply, upon command, sufficient power to operate stepping motors 645 and 650.

Figure 7:
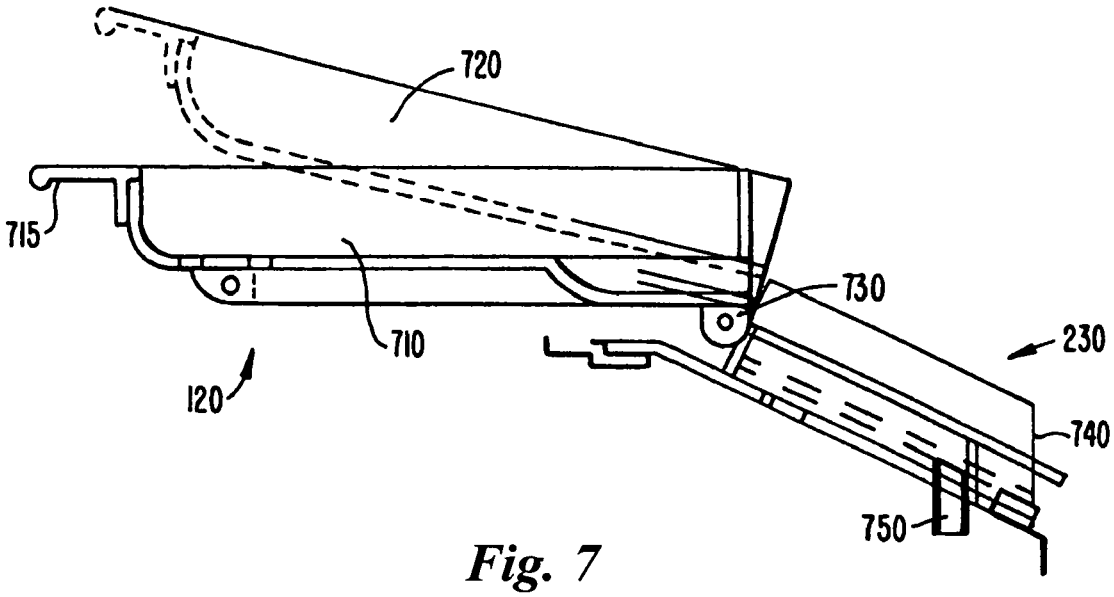
FIG. 7 is a side view of the coin tray and the waste management system.

FIG. 7 is a side view of coin tray 120 and waste management chute 230. Coin tray 120 normally is flush with the top surface of kiosk 100 (Position 710). The user places their coins in the tray and at this point removes any obvious foreign materials. When the user is ready to begin the sorting process, they lift handle 715 on coin tray 120. The tray is hinged at point 730. When tray 120 is in position 720, the coins fall through waste management chute 230. The coins leave chute 230 through opening 740 to enter the coin sorting and counting mechanism. Liquids accidently dropped into the coin hopper are funneled through spout 750 to a suitable collection receptacle.

Figure 8A:
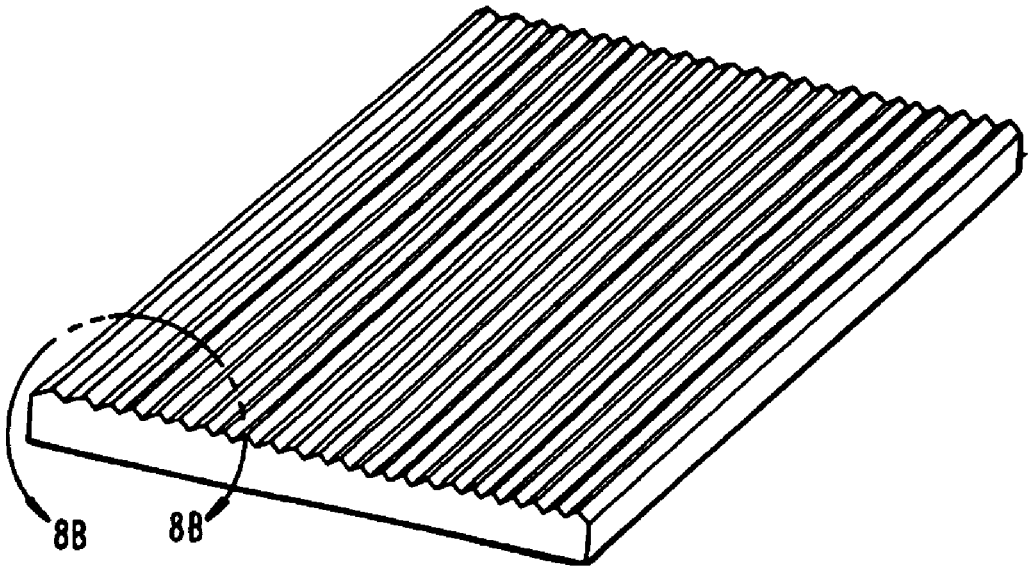
FIGS. 8A-B is a diagram of the bottom plate of the waste management system.
Figure 8B:
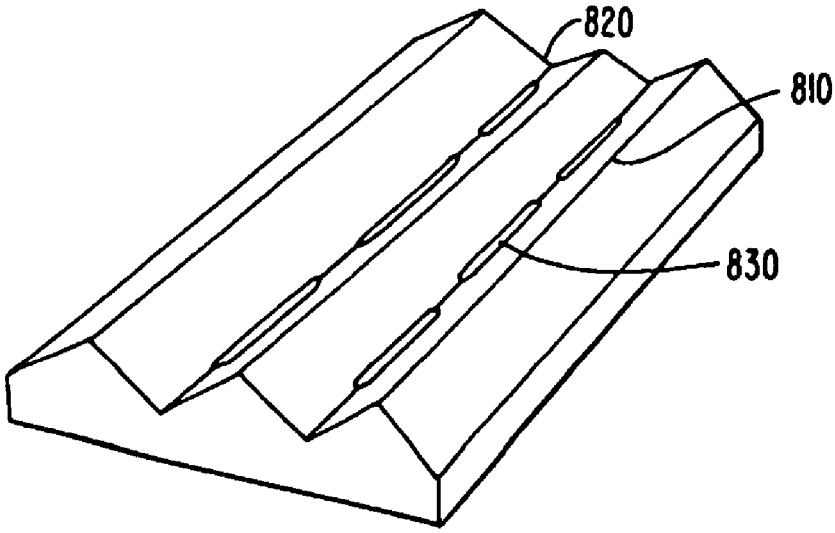

FIG. 8A is a diagram of the bottom plate of waste management system 230. FIG. 8B is an enlarged view of a small section of this plate. The surface of the plate has grooves running lengthwise, these grooves forming a series of alternating peaks 810 and valleys 820. The coins ride along the surface of the plate while liquids flow down the valleys 820, eventually flowing through perforations 830 drilled in the bottom of the valleys 820. The liquids are then funneled down spout 750, and collected. The sharp peaks 810, combined with a teflon coating, help minimize the friction caused by the liquids which may accompany the coins. This in turn helps prevent a slow down of the sorting process.

Figure 9:
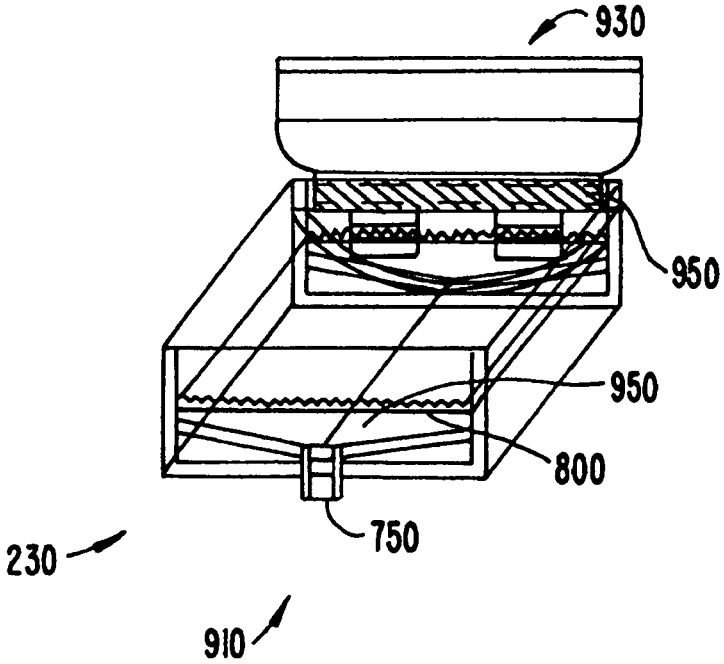
FIG. 9 is a three-dimensional view of the waste management system.

FIG. 9 is a three dimensional view of the waste management chute 230. The coins enter and travel down the chute in direction 930. As the coins travel down this chute, a fan (not shown) blows air back up the chute in direction 910. Light materials, such as small papers and lint, are blown free from the coins and out of the machine. Liquids flow through the holes in bottom plate 800, flow through spout 750, and are collected in a separate receptacle. Magnetic strips 950 along the exit edge of the coin hopper and the entry edge of the waste management chute collect ferrous objects, such as tokens and slugs, removing them from the coins.

Figure 10:
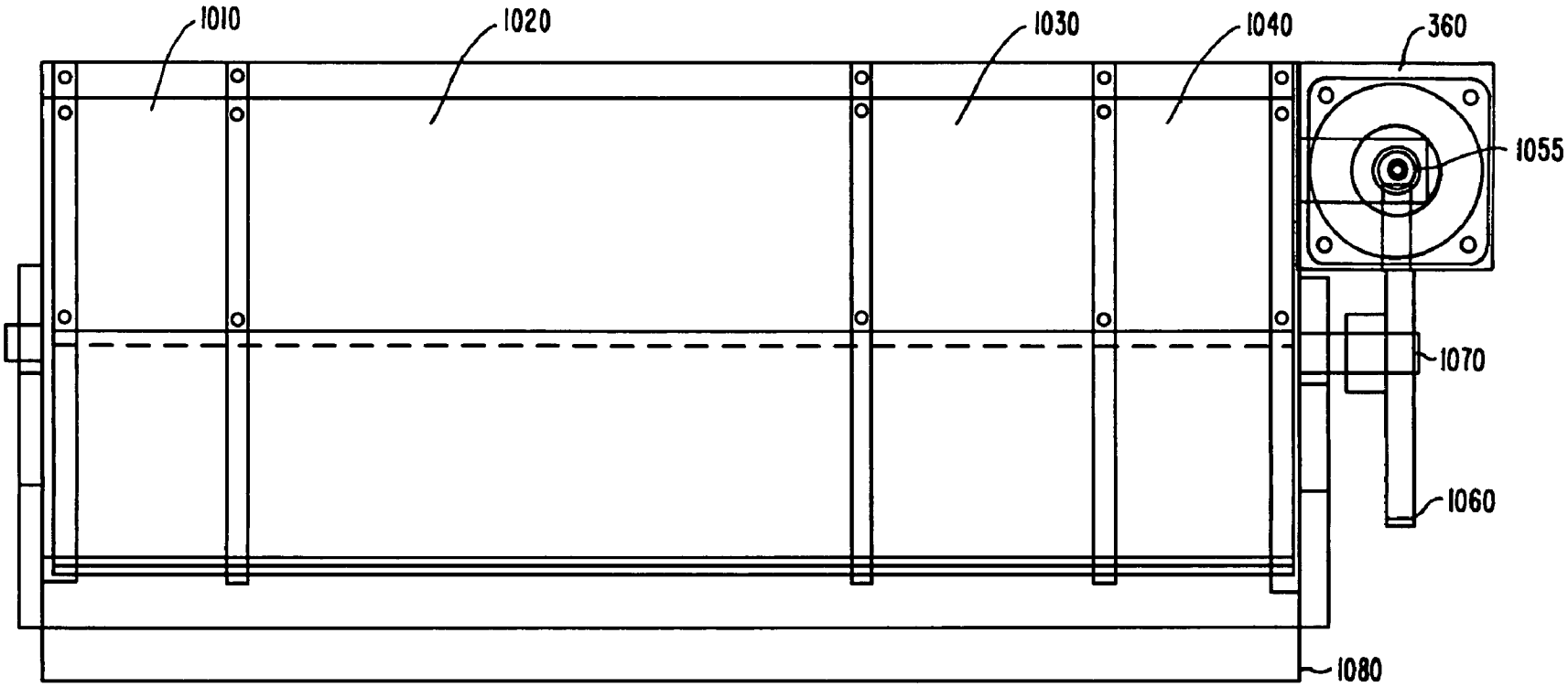
FIG. 10 is a front view of the escrow tray.

FIG. 10 is a front view of the escrow tray 105. Tray 105 is divided into four bins. Bin 1010 catches dimes from sorter 280; bin 1020 catches pennies; bin 1030 catches nickels; and bin 1040 catches quarters. Stepping motor 360 drives worm gears 1055 and 1060. When activated, stepping motor 360 moves the bottom surface 1080 of the tray along axis 1070. If the tray bottom 1080 is rotated outward, toward the user, the coins are dumped into a coin storage receptacle. If the tray bottom 1080 is rotated inward, away from the user, then the coins are dumped into a return receptacle.

Figure 11:
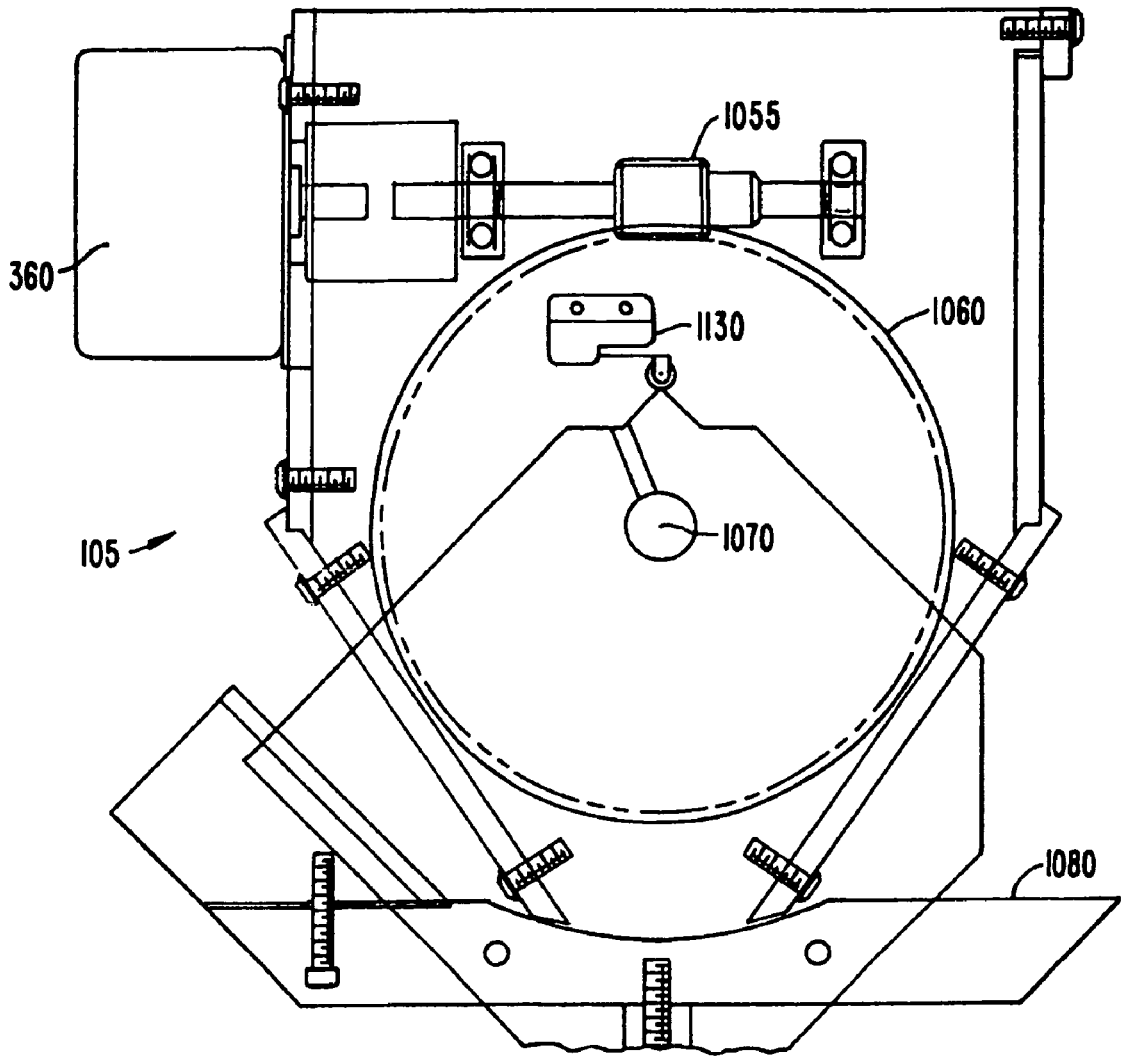
FIG. 11 is a side view of the escrow tray.

FIG. 11 is a side view of the escrow tray 105. Stepping motor 360 drives worm gears 1055 and 1060. When the stepping motor 360 is activated, worm gear 1060 is rotated along axis 1070. When gear 1060 is rotated clockwise, the bottom surface 1080 is rotated allowing the coins to be returned to the user in tray 170. When gear 1060 is rotated counter-clockwise, the bottom surface 1080 is rotated allowing the coins to be dumped into a coin depository. Microswitch 1130 prevents the stepping motor from moving the tray bottom 1080 past its pre-determined stops.

As will be understood by those familiar with the art, the present invention may be embodied in other specific forms without departing from the spirit or essential characteristics thereof. For example, the same printer could be used to print both the vouchers and periodic maintenance reports. Accordingly, disclosure of the preferred embodiments of the invention is intended to be illustrative, but not limiting, of the scope of the invention which is set forth in the following claims.

We claim:

1. A consumer coin counting machine, the coin counting machine comprising:

an input region configured to receive a plurality of randomly oriented coins from a user;

a coin discriminator configured to receive the coins from the input region and count the coins to determine a total;

an intermediate holding area for at least temporarily holding the coins counted by the coin discriminator;

a display device operably connected to the coin discriminator and configured to display at least one of the total and a value related to the total; and a user selection device, wherein the coins held in the intermediate holding area are returned to the user in response to receiving a first user input via the user selection device rejecting at least one of the total and the value related to the total, and wherein a redeemable voucher is dispensed from the coin counting machine in response to receiving a second user input via the user selection device accepting at least one of the total and the value related to the total.

2. The coin counting machine of claim 1 wherein the user selection device includes first and second buttons, wherein the coins held in the intermediate holding area are returned to the user in response to the user depressing the first button, and wherein the redeemable voucher is dispensed from the coin counting machine in response to the user depressing the second button.

3. The coin counting machine of claim 1 wherein the voucher is redeemable for at least one of cash and merchandize in a non-bank retail location in which the coin counting machine is located.

4. The coin counting machine of claim 1 wherein the voucher is redeemable for at least one of cash and merchandize for the value related to the total.

5. The coin counting machine of claim 1 wherein the display device is configured to display the total and the value related to the total, and wherein the value is less than the total.

6. The coin counting machine of claim 1 wherein the display device is configured to display the total and the value related to the total, and wherein the value is a set percentage less than the total.

7. The coin counting machine of claim 1 wherein the display device is configured to display the total and the value related to the total, wherein the redeemable voucher includes an indication of the total and the value related to the total, and wherein the value is less than the total.

8. The coin counting machine of claim 1 wherein the input region is configured to receive a plurality of randomly oriented coins of multiple denominations from a user, and wherein the display device is configured to display sub-totals for each of the individual coin denominations.

9. The coin counting machine of claim 1 wherein the redeemable voucher includes anticounterfeiting information.

10. The coin counting machine of claim 1 wherein the redeemable voucher includes a substrate, and wherein the coin counting machine further comprises a voucher printer configured to print at least one of the total and the value related to the total on the substrate in machine-readable form.

11. The coin counting machine of claim 1 wherein the redeemable voucher includes a substrate, and wherein the coin counting machine further comprises a voucher printer configured to print at least one of the total and the value related to the total on the substrate in bar code.

12. The coin counting machine of claim 1 wherein the input region includes a coin cleaning facility configured to separate non-coin items from the plurality of randomly oriented coin received from the user.

13. The coin counting machine of claim 1 wherein the input region includes at least one hole configured to separate non-coin material from the plurality of randomly oriented coin received from the user.

14. A consumer coin counting machine, the coin counting machine comprising:

an input region configured to receive a plurality of randomly oriented coins from a user;

a user input device at least one debris removal feature for separating foreign objects from the coins received from the user;

a coin discriminator configured to receive the coins from the input region and count the coins to determine a total;

an intermediate holding area for at least temporarily holding the coins counted by the coin discriminator; and a display device operably connected to the coin discriminator and configured to display at least one of the total and a value related to the total, wherein the coins held in the intermediate holding area are returned to the user in response to a first user input via the input device rejecting at least one of the total and the value related to the total, and wherein a redeemable voucher is dispensed from the coin counting machine in response to a second user input via the input device accepting at least one of the total and the value related to the total.

15. The coin counting machine of claim 14 wherein the debris removal feature includes a fan configured to blow light weight debris, such as lint and dust, away from the coins.

16. The coin counting machine of claim 14 wherein the debris removal feature includes at least one hole through which liquid can be flowed away from the coins.

17. A consumer coin counting machine, the coin counting machine comprising:

an input area configured to receive multiple randomly oriented coins from a user;

a user input device a coin discriminator configured to receive the coins from the input area and count the coins to determine a total;

an intermediate holding area for at least temporarily holding the coins counted by the coin discriminator;

a display device operably connected to the coin discriminator and configured to display at least one of the total and a value related to the total; and a voucher dispenser, wherein the coins held in the intermediate holding area are returned to the user in response to one user input via the user input device rejecting at least one of the total and the value related to the total, and wherein a redeemable voucher is dispensed by the voucher dispenser in response to another user input via the input device accepting at least one of the total and the value related to the total.

18. The coin counting machine of claim 17 wherein the voucher is redeemable for at least one of cash and merchandize in a non-bank retail location in which the coin counting machine is located.

19. The coin counting machine of claim 17 wherein the voucher is redeemable for at least one of cash and merchandize for the value related to the total, and wherein the value is less than the total.

20. The coin counting machine of claim 17 wherein the display device is configured to display the total and the value related to the total, and wherein the redeemable voucher includes an indication of the total and the value related to the total.

21. The coin counting machine of claim 17 wherein the input region is configured to receive a plurality of randomly oriented coins of multiple denominations from a user, and wherein the display device is configured to display sub-totals associated with each of the individual coin denominations.

22. The coin counting machine of claim 17 wherein the redeemable voucher includes anticounterfeiting information.

23. The coin counting machine of claim 17 wherein the redeemable voucher includes a transaction number.

24. The coin counting machine of claim 17 wherein the redeemable voucher includes a substrate, and wherein the coin counting machine further comprises a voucher printer configured to print at least one of the total and the value related to the total on the substrate in machine-readable form.

25. The coin counting machine of claim 17 wherein the redeemable voucher includes a substrate, and wherein the coin counting machine further comprises a voucher printer configured to print at least one of the total, the value related to the total, and a transaction number on the substrate in bar code.

26. A method for counting coins, the method comprising:

providing a coin counting machine, the coin counting machine having a coin input area, user selection device, a coin discriminator that receives coins from the coin input area, and a coin holding area that receives coins from the coin discriminator;

receiving from a user, in the coin input area, a plurality of randomly oriented coins of multiple denominations;

transferring the plurality of coins from the coin input area to the coin discriminator, and discriminating the coins to determine a total;

transferring the plurality of coins from the coin discriminator to the coin holding area, and temporarily holding the coins in the coin holding area;

displaying at least one of the total and a value related to the total to the user;

dispensing a redeemable voucher to the user when the user accepts at least one of the total and the value related to the total via the user selection device; and returning the coins held in the coin holding area to the user when the user rejects at least one of the total and the value related to the total via the user selection device.

27. The method of claim 26 wherein discriminating the coins to determine a total includes sequentially rolling the coins past a coin sensor.

28. The method of claim 26 wherein the user selection device includes first and second buttons, wherein dispensing a redeemable voucher to the user includes dispensing the redeemable voucher when the user accepts at least one of the total and the value related to the total by pressing the first button, and wherein returning the coins held in the coin holding area to the user includes returning the coins when the user rejects at least one of the total and the value related to the total by pressing the second button.

29. The method of claim 26 wherein providing a coin counting machine includes providing a coin counting machine in a non-bank retail location, and wherein dispensing a redeemable voucher includes dispensing a voucher that is redeemable for at least one of cash and merchandize in the non-bank retail location.

30. The method of claim 26 wherein displaying at least one of the total and a value related to the total includes displaying the total and the value related to the total, wherein dispensing a redeemable voucher includes dispensing a redeemable voucher that includes an indication of the total and the value related to the total, and wherein the value is less than the total.

31. The method of claim 26 wherein dispensing a redeemable voucher includes dispensing a redeemable voucher that includes anticounterfeiting information.

32. The method of claim 26 wherein displaying at least one of the total and a value related to the total includes displaying the total and the value related to the total, wherein dispensing a redeemable voucher includes dispensing a redeemable voucher that includes at least one of the total and the value related to the total in bar code.

33. The method of claim 26, further comprising cleaning the plurality of coins received from the user before transferring the plurality of coins from the coin input area to the coin discriminator.

34. A system for counting coins, the system comprising:

means for receiving a plurality of randomly oriented coins from a user;

means for discriminating the plurality of coins to determine a total;

means for temporarily holding the plurality of discriminated coins;

means for displaying at least one of the total and a value related to the total;

means for dispensing a redeemable voucher to the user in response to a first user selection via the means for receiving user input, wherein the first user selection accepts at least one of the total and the value related to the total; and means for returning the plurality of held coins to the user in response to a second user selection via the means for receiving user input, wherein the second user selection rejects at least one of the total and the value related to the total.

35. The system of claim 34 wherein the means for receiving user input include button means for receiving at least one of the first user selection and the second user selection from the user.

36. The system of claim 34 wherein the means for dispensing a redeemable voucher include means for dispensing a voucher that is redeemable for at least one of cash and merchandize in a non-bank retail location.

37. The system of claim 34 wherein the means for receiving a plurality of randomly oriented coins from a user include means for at least substantially simultaneously receiving a plurality of randomly oriented coins of multiple denominations.

38. The system of claim 34, further comprising means for removing debris from the plurality of coins before discriminating the coins to determine a total.

39. The system of claim 34 wherein the means for dispensing a redeemable voucher include means for dispensing a redeemable voucher that includes anticounterfeiting information.

* * * * *

UNITED STATES PATENT AND TRADEMARK OFFICE

CERTIFICATE OF CORRECTION

PATENT NO. : 7,971,699 B2
APPLICATION NO. : 11/336413
DATED : July 5, 2011
INVENTOR(S) : Jens H. Molbak et al.

It is certified that error appears in the above-identified patent and that said Letters Patent is hereby corrected as shown below:

On page 4, under "Other Publications", in column 1, line 39, delete "ans" and insert -- and --, therefor.

In column 9, line 19, in Claim 14, after "device" insert -- ; --.

In column 9, line 47, in Claim 17, after "device" insert -- ; --.

In column 9, line 62, in Claim 17, before "input" insert -- user --.

In column 10, line 33, in Claim 26, after "area," insert -- a --.

In column 11, line 26, in Claim 34, after "user;" insert -- means for receiving user input; --.

Signed and Sealed this
Tenth Day of April, 2012

David J. Kappos

David J. Kappos
*Director of the United States Patent and Trademark Office*